US009956787B2

(12) United States Patent
Nemoto et al.

(10) Patent No.: US 9,956,787 B2
(45) Date of Patent: May 1, 2018

(54) LASER RECORDING DEVICE AND RECORDING METHOD

(71) Applicant: Kabushiki Kaisha Toshiba, Minato-ku (JP)

(72) Inventors: Nobuki Nemoto, Kawasaki (JP); Fumitoshi Morimoto, Shirakawa (JP); Takahisa Nakano, Kawasaki (JP); Shota Kure, Kawasaki (JP); Takashi Yamaguchi, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days. days.

(21) Appl. No.: 15/062,650

(22) Filed: Mar. 7, 2016

(65) Prior Publication Data

US 2017/0066251 A1 Mar. 9, 2017

(30) Foreign Application Priority Data

Sep. 8, 2015 (JP) ..... 2015-176714
Feb. 25, 2016 (JP) ..... 2016-034398

(51) Int. Cl.
*B41J 2/475* (2006.01)
*B41J 2/44* (2006.01)
*B41J 2/435* (2006.01)

(52) U.S. Cl.
CPC ..... *B41J 2/4753* (2013.01); *B41J 2/435* (2013.01); *B41J 2/442* (2013.01)

(58) Field of Classification Search
CPC .... B41J 25/304; B41J 25/308; B41J 25/3088; B41J 25/3086; B41J 25/3084; B41J 25/3082
See application file for complete search history.

(56) References Cited

U.S. PATENT DOCUMENTS 4,755,831 A 7/1988 Sakamoto
7,300,694 B2 11/2007 Lutz et al.
(Continued)

FOREIGN PATENT DOCUMENTS

EP 2 730 425 A1 5/2014
JP 2004-25739 1/2004
(Continued)

OTHER PUBLICATIONS

Extended European Search Report dated Apr. 13, 2017 in European Patent Application No. 16158923.9.

*Primary Examiner* — Kristal Feggins
(74) *Attorney, Agent, or Firm* — Oblon, McClelland, Maier & Neustadt, L.L.P.

(57) ABSTRACT

According to one embodiment, a laser recording device performs recording by irradiating a recording medium with laser light. The recording medium includes thermal recording layers including thermal materials with different color development threshold temperatures and stacked in an ascending order of the threshold temperatures of the included thermal materials from a surface irradiated with the laser light; and an intermediate layer provided between the thermal recording layers to perform thermal insulation and thermal conduction. The laser recording device includes a controller. The controller sets a power density of the laser light and an irradiation time and performs recording on the thermal recording layers by controlling irradiation with the laser light. The power density is relatively higher at recording of any of the thermal recording layers with a higher threshold temperature. The irradiation time is effectively longer at recording of any of the thermal recording layers with a lower threshold temperature.

4 Claims, 30 Drawing Sheets

(56) References Cited

U.S. PATENT DOCUMENTS

| | | | |
|---|---|---|---|
| 7,403,651 | B2 | 7/2008 | Lutz et al. |
| 8,133,652 | B2 | 3/2012 | Kawahara et al. |
| 8,633,958 | B2 | 1/2014 | Kawahara et al. |
| 2003/0125206 | A1 | 7/2003 | Bhatt et al. |
| 2004/0180284 | A1 | 9/2004 | Bhatt et al. |
| 2005/0052521 | A1 | 3/2005 | Bhatt et al. |
| 2006/0270552 | A1 | 11/2006 | Bhatt et al. |
| 2006/0276335 | A1 | 12/2006 | Tsuboi et al. |
| 2015/0151550 | A1 | 6/2015 | Asai et al. |

FOREIGN PATENT DOCUMENTS

| | | |
|---|---|---|
| JP | 3509246 | 3/2004 |
| JP | 2005-138558 | 6/2005 |
| JP | 4091423 | 5/2008 |
| JP | 2008-179131 | 8/2008 |
| JP | 2010-131878 | 6/2010 |
| WO | WO 02/096665 A1 | 12/2002 |
| WO | WO 2013/176236 A1 | 11/2013 |

| | HIGH-TEMPERATURE COLOR DEVELOPING LAYER | MEDIUM-TEMPERATURE COLOR DEVELOPING LAYER | LOW-TEMPERATURE COLOR DEVELOPING LAYER |
|---|---|---|---|
| POWER DENSITY | PDh | PDm | PDl |
| RECORDING TIME | th | tm | tl |

FIG.9

| | | | | | | |
|---|---|---|---|---|---|---|
| (FIRST ROW) | 1 | 2 | 3 | 4 | ⋯ | $\alpha$ |
| (SECOND ROW) | $\alpha+1$ | $\alpha+2$ | | | | $2\alpha$ |
| ⋮ | | | | | | $3\alpha$ |
| | | | | | | $4\alpha$ |
| | | | | | | $5\alpha$ |
| | | | n | n+1 | | $6\alpha$ |
| | ⋮ | | | | ⋱ | |
| | | | | | | |

FIG.20

| | COLOR DEVELOPMENT OF LOW- AND MEDIUM-TEMPERATURE COLOR DEVELOPING LAYERS | COLOR DEVELOPMENT OF MEDIUM- AND HIGH-TEMPERATURE COLOR DEVELOPING LAYERS | COLOR DEVELOPMENT OF LOW-, MEDIUM, AND HIGH-TEMPERATURE COLOR DEVELOPING LAYERS |
|---|---|---|---|
| IRRADIATION CONDITION | T(E)>Tl(E), T(E)>Tm(E), AND T(E)<Th(E) | T(E)<Tl(E), T(E)>Tm(E), AND T(E)>Th(E) | T(E)>Tl(E), T(E)>Tm(E), AND T(E)>Th(E) |
| CORRESPONDING REGION | $A_{LM}$ | $A_{MH}$ | $A_{LMH}$ |

FIG.21

| | THICKNESS [μm] | THERMAL CONDUCTIVITY [W/m/K] |
|---|---|---|
| SUBSTRATE 12 | 100 | 0.01 TO 5.00 |
| LOW-TEMPERATURE (C) COLOR DEVELOPING LAYER 13 | 1 TO 10 | 0.1 TO 10 |
| FIRST SPACER LAYER 14 | 7 TO 100 | 0.01 TO 1 |
| MEDIUM-TEMPERATURE (M) COLOR DEVELOPING LAYER 15 | 1 TO 10 | 0.1 TO 10 |
| SECOND SPACER LAYER 16 | 1 TO 10 | 0.01 TO 1 |
| HIGH-TEMPERATURE COLOR DEVELOPING LAYER 17 | 0.5 TO 5 | 0.1 TO 10 |
| PROTECTIVE LAYER 18 | 0.5 TO 5 | 0.01 TO 1 |

COLOR DEVELOPMENT IN B

COLOR DEVELOPMENT IN R

COLOR DEVELOPMENT IN K

COLOR DEVELOPMENT IN C

COLOR DEVELOPMENT IN M

COLOR DEVELOPMENT IN Y

LASER RECORDING DEVICE AND RECORDING METHOD

CROSS-REFERENCE TO RELATED APPLICATIONS

This application is based upon and claims the benefit of priority from Japanese Patent Application No. 2015-176714, filed Sep. 8, 2015 and Japanese Patent Application No. 2016-034398, filed Feb. 25, 2016, the entire contents of which are incorporated herein by reference.

FIELD

Embodiments described herein relate generally to a laser recording device and a recording method.

BACKGROUND

In direct laser recording on a recording medium, the conventional laser recording method is only able to perform recording in a single color by exploiting carbonization of the recording medium at a recording position (laser irradiation position) and a color change due to a reaction with a color former.

Disclosed methods include a method of recording a multicolor image by controlling a condensing position of laser light on a film such as a transfer film or a laminate film, or on a plastic object including such a film.

However, the conventional technology requires a plurality of laser light source devices having different wavelengths and a plurality of ultraviolet light irradiation devices to stop color development, which makes it difficult to reduce the cost and size of the device. In addition, changing the condensing position of laser depending on a color developing layer is likely to cause degradation of the quality of a record image because of, for example, distortion and irregularity of the recording medium, and variation in an optical system and the thickness of the color developing layer.

The present invention has been made in view of the foregoing and provides a laser recording device that performs image recording through scanning with laser light and is capable of achieving a simplified device configuration while maintaining and improving the quality of a record image.

BRIEF DESCRIPTION OF THE DRAWINGS

FIG. 9 is an explanatory diagram of numbering of pixels included in the image corresponding to input image data;

FIG. 20 is an explanatory table of exemplary laser irradiation conditions;

FIG. 21 is an explanatory table of a specific configuration example of the recording medium;

DETAILED DESCRIPTION

In general, according to one embodiment, a laser recording device performs recording by irradiating a recording medium with laser light. The recording medium includes a plurality of thermal recording layers including thermal materials with different color development threshold temperatures and stacked in an ascending order of the threshold temperatures of the included thermal materials from a surface irradiated with the laser light; and an intermediate layer provided between the thermal recording layers to perform thermal insulation and thermal conduction. The laser recording device comprises a controller. The controller sets a power density of the laser light and an irradiation time and performs recording on the thermal recording layers as recording targets by controlling irradiation with the laser light having the power density for the irradiation time. The power density is relatively higher at recording of any of the thermal recording layers with a higher threshold temperature. The irradiation time is effectively longer at recording of any of the thermal recording layers with a lower threshold temperature.

Exemplary embodiments of the present invention will be described below with reference to the accompanying drawings.

1. First Embodiment

The following first describes the principle of a first embodiment of the present invention.

A laser recording method according to the first embodiment selectively develops colors of layers by controlling, through the way of heating by a laser, in other words, through an irradiation condition of the laser, temperature change of the layers caused by conduction of heat to the layers, the heat being generated at least on a protective layer 18 through laser irradiation.

Figure 1:
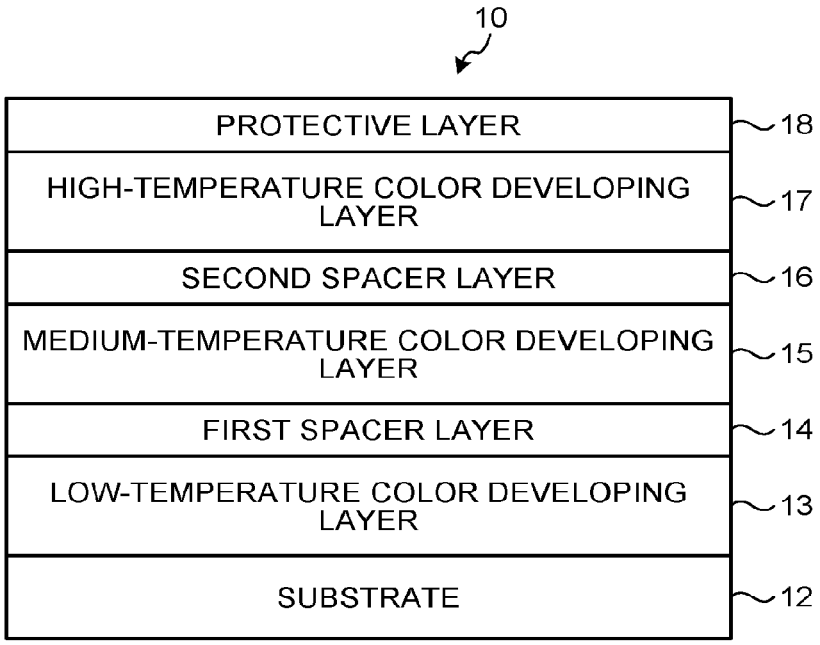
FIG. 1 is a schematic explanatory diagram of the configuration of a recording medium according to an embodiment.

FIG. 1 is a schematic explanatory diagram of the configuration of a recording medium according to an embodiment.

As illustrated in FIG. 1, this recording medium 10 includes, on a substrate 12, a stack of a low-temperature color developing layer 13, a first spacer layer 14, a medium-temperature color developing layer 15, a second spacer layer 16, a high-temperature color developing layer 17, and the protective layer 18 in this order. The low-temperature color developing layer 13, the medium-temperature color developing layer 15, and the high-temperature color developing layer 17 serve as thermal recording layers (a low-temperature thermal recording layer, a medium-temperature thermal recording layer, and a high temperature thermal recording layer) on which image recording is performed, and the first spacer layer 14 and the second spacer layer 16 serve as intermediate layers providing thermal insulation and thermal conduction.

In the above-described configuration, the substrate 12 supports the low-temperature color developing layer 13, the first spacer layer 14, the medium-temperature color developing layer 15, the second spacer layer 16, the high-temperature color developing layer 17, and the protective layer 18.

The low-temperature color developing layer 13 contains a thermosensitive material as a thermal material that develops color at a temperature equal to or higher than a first threshold temperature Tl.

The first spacer layer 14 provides a thermal barrier to the low-temperature color developing layer 13 when not developing color, and reduces thermal conduction from the medium-temperature color developing layer 15 to the low-temperature color developing layer 13.

The medium-temperature color developing layer 15 contains a thermosensitive material as a thermal material that develops color at a temperature equal to or higher than a second threshold temperature Tm (>Tl).

The second spacer layer 16 provides a thermal barrier to the medium-temperature color developing layer 15 when not developing color, and reduces thermal conduction from the high-temperature color developing layer 17 to the medium-temperature color developing layer 15.

The high-temperature color developing layer 17 contains a thermosensitive material as a thermal material that develops color at a temperature equal to or higher than a third threshold temperature Th (>Tm).

The protective layer 18 protects the low-temperature color developing layer 13, the first spacer layer 14, the medium-temperature color developing layer 15, the second spacer layer 16, and the high-temperature color developing layer 17.

FIGS. 2A to 2C are each an explanatory diagram of the color development principle of single color development in the embodiment.

Figure 2:
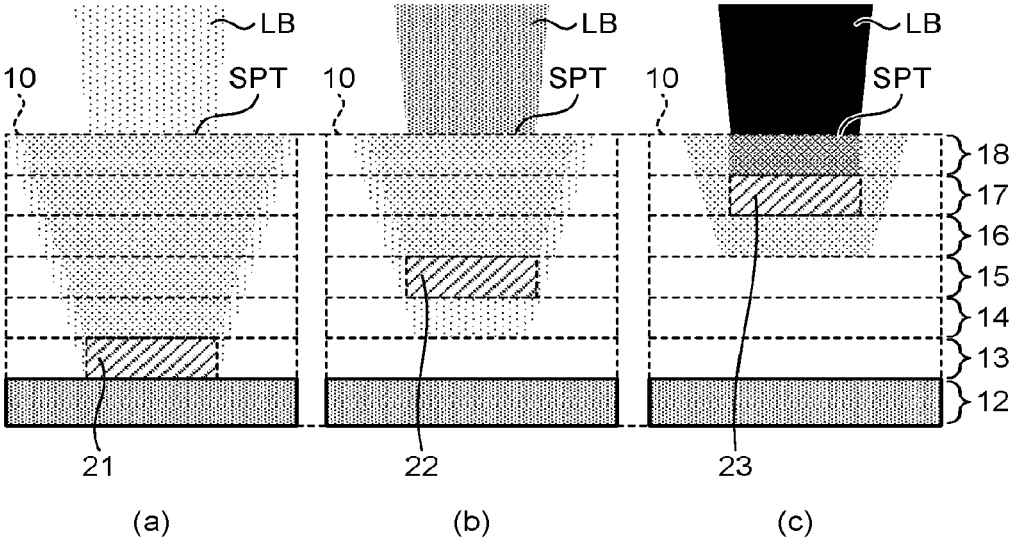
FIG. 2 is an explanatory diagram of a color development principle of single color development in the embodiment.

FIG. 2(*a*) is a principle explanatory diagram of individual color development of the low-temperature color developing layer 13.

FIG. 2(*b*) is a principle explanatory diagram of individual color development of the medium-temperature color developing layer 15.

FIG. 2(*c*) is a principle explanatory diagram of individual color development of the high-temperature color developing layer 17.

The individual color development of the low-temperature color developing layer 13 requires heat conduction from a laser irradiation position to the low-temperature color developing layer 13. Simultaneously, recording is performed under such a laser irradiation condition that the temperature of the medium-temperature color developing layer 15 does not exceed the second threshold temperature Tm, and the temperature of the high-temperature color developing layer 17 does not exceed the third threshold temperature Th.

As a result, as illustrated in FIG. 2(*a*), the low-temperature color developing layer 13 develops color in a color development region 21.

The individual color development of the medium-temperature color developing layer 15 requires heat conduction from a laser irradiation position to the medium-temperature color developing layer 15. Simultaneously, recording is performed under such a laser irradiation condition that the temperature of the high-temperature color developing layer 17 does not exceed the third threshold temperature Th and the temperature of the low-temperature color developing layer 13 does not exceed the first threshold temperature Tl due to reduced thermal conduction through the spacer layer 14.

As a result, as illustrated in FIG. 2(*b*), the medium-temperature color developing layer 15 develops color in a color development region 22.

The individual color development of the high-temperature color developing layer 17 requires heat conduction from a laser irradiation position to the high-temperature color developing layer 17. Simultaneously, recording is performed under such a laser irradiation condition that the temperature of the medium-temperature color developing layer 15 does not exceed the second threshold temperature Tm and the temperature of the low-temperature color developing layer 13 does not exceed the first threshold temperature Tl due to reduced thermal conduction through the spacer layer 16 and the spacer layer 14.

As a result, as illustrated in FIG. 2(*c*), the high-temperature color developing layer 17 develops color in a color development region 23.

Figures 3, 4:
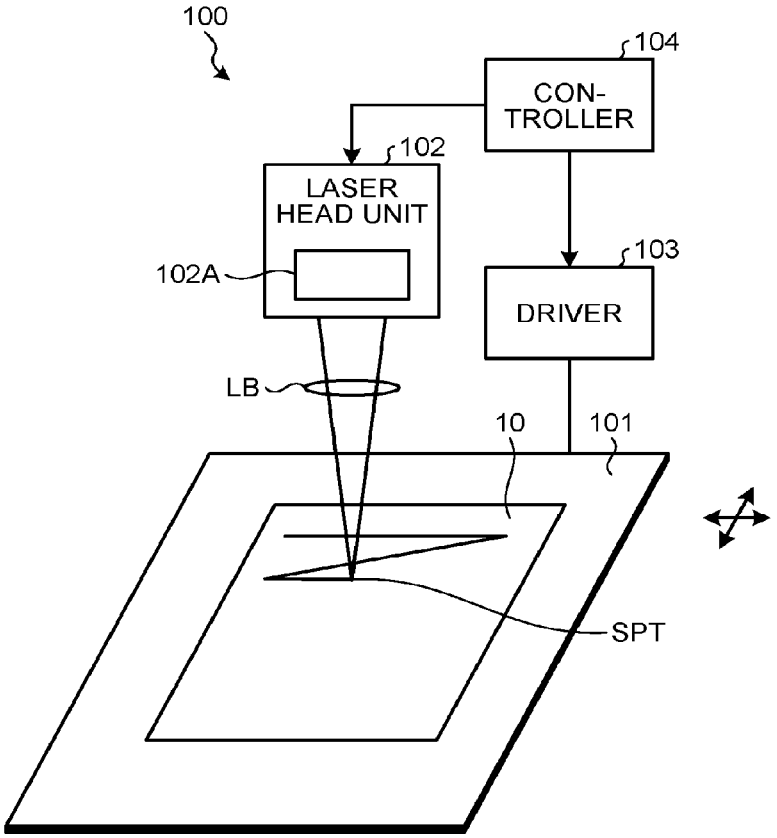
FIG. 3 is an explanatory table of exemplary laser irradiation conditions.
FIG. 4 is a schematic block diagram of the configuration of a laser recording device in the embodiment.

FIG. 3 is an explanatory table of exemplary laser irradiation conditions.

The following conditions are satisfied:

$$PDl<PDm<PDh, \text{ and } th<tm<tl$$

where PDl, PDm, and PDh are power densities of laser light for color development of the low-temperature color developing layer 13, the medium-temperature color developing layer 15, and the high-temperature color developing layer 17 and th, tm, and tl are recording times of the laser light as listed in FIG. 3.

In other words, the power densities have the following relation:

$$PDl+\alpha 1=PDm+\alpha 2=PDh(\alpha 1>\alpha 2>0)$$

In this case, the values of $\alpha$1 and $\alpha$2 are set as appropriate in advance in accordance with the materials of the low-temperature color developing layer 13, the medium-temperature color developing layer 15, and the high-temperature color developing layer 17.

The recording times have the following relation:

$$th+\beta 1=tm+\beta 2=tl(\beta 1>\beta 2>0)$$

In this case, the values of $\beta$1 and $\beta$2 are set as appropriate in advance in accordance with the materials of the low-temperature color developing layer 13, the medium-temperature color developing layer 15, and the high-temperature color developing layer 17.

In other words, the power density PDl is set to be the lowest and the recording time tl is set to be the longest to achieve selective color development of the low-temperature color developing layer 13.

Laser light irradiation under these conditions achieves such heat conduction to the medium-temperature color developing layer 15 and the high-temperature color developing layer 17 that the temperature of the medium-temperature color developing layer 15 does not exceed the second threshold temperature Tm and the temperature of the high-temperature color developing layer 17 does not exceed the third threshold temperature Th whereas the temperature of the low-temperature color developing layer 13 exceeds the first threshold temperature Tl.

The power density PDh is set to be the highest and the recording time th is set to be the shortest to achieve selective color development of the high-temperature color developing layer 17. Laser light irradiation under these conditions achieves such heat conduction to the medium-temperature color developing layer 15 and the low-temperature color developing layer 13 that the temperature of the medium-temperature color developing layer 15 does not exceed the second threshold temperature Tm and the temperature of the low-temperature color developing layer 13 does not exceed the first threshold temperature Tl whereas the high-temperature color developing layer 17 exceeds the third threshold temperature Th.

The power density PDm and the recording time tm are set to be medium as defined above to achieve selective color development of the medium-temperature color developing layer 15 only.

Laser irradiation under these conditions achieves such heat conduction to the high-temperature color developing layer 17 and the low-temperature color developing layer 13 that the temperature of the high-temperature color developing layer 17 does not exceed the third threshold temperature Th and the temperature of the low-temperature color developing layer 13 does not exceed the first threshold temperature Tl whereas the temperature of the medium-temperature color developing layer 15 exceeds the second threshold temperature Tm.

The selective color development of the layers corresponding to the respective three primary colors achieved as described above enables full-color recording in combinations of the three primary colors. In addition, the method according to the present embodiment achieves such recording that the three primary colors are placed over in a stacking direction of layers in a recording medium, thereby providing a good-looking image even at a relatively low resolution as compared to individual arrangements of the three primary colors on a two-dimensional plane.

The following provides a more detailed description of the embodiment.

FIG. 4 is a schematic block diagram of the configuration of a laser recording device according to the embodiment.

This laser recording device 100 includes a laser head unit 102 that emits recording laser light LB onto the recording medium 10 placed on a recording stage 101, a driver 103 that drives the recording stage 101 so that the laser light LB emitted from the laser head unit 102 is effectively scanned, and a controller 104 as a microcomputer that controls the laser head unit 102 and the driver 103 based on externally input record image data.

In the above-described configuration, the laser head unit 102 includes a spot controller 102A as an optical system that controls the focal position of the laser light LB and the spot diameter of the laser light LB under the control of the controller 104.

The controller 104 controls the power density, irradiation time, focal position, spot diameter, and other parameters of the laser light LB emitted from the laser head unit 102 based on a pre-stored control program.

1. First Embodiment

First, a description will be made of a method of achieving selective color development in the three primary colors through control on the recording time by changing a laser scanning speed for each color as a color development target for the recording medium 10 in which the three color developing layers having the different threshold temperatures Tl, Tm, and Th and corresponding to the respective three primary colors are stacked.

In the first embodiment, the scanning speed of the laser light LB is controlled as a parameter for controlling the recording time. In other words, the recording time is controlled to be relatively long by relatively slowing the scanning speed of the laser light LB.

Figure 5:
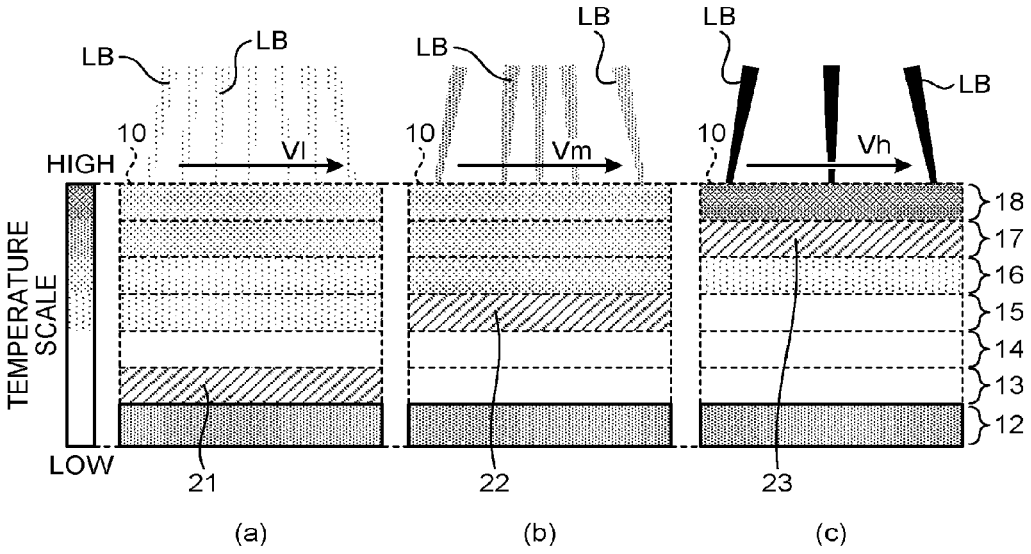
FIG. 5 is a schematic diagram of laser irradiation along a section viewed perpendicularly to a stacking direction of layers in the recording medium.

FIG. 5 is a schematic diagram of laser irradiation along a section viewed perpendicularly to a stacking direction of layers in the recording medium.

FIG. 6 is a schematic diagram of irradiation with the laser light LB viewed in the incident direction of the laser light LB.

Figures 6A, 6B, 6C:
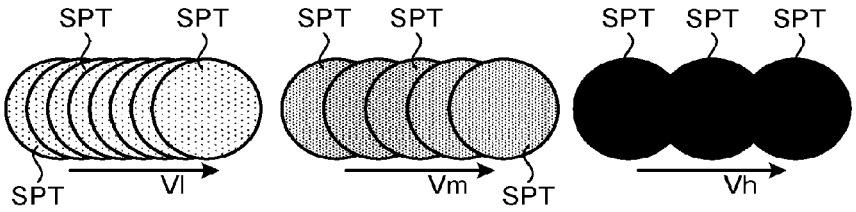
FIGS. 6A to 6C are each a schematic diagram of irradiation with laser light LB viewed in the incident direction of the laser light LB.

FIGS. 6A to 6C each schematically illustrate the position of a spot SPT of the laser light LB for each unit time.

FIG. 5(*a*) and FIG. 6A illustrate the power density and the scanning speed of the laser light LB to achieve selective color development of the low-temperature color developing layer 13. For the individual color development of the low-temperature color developing layer 13, laser scanning is performed with, for example, a power density PDl of 0.01 to 15.0 [W/cm$^2$] and a scanning speed V1 of 1.0 to 90 [mm/s].

The power density PDl is set to be in this range because of the following reasons: for the power density PDl<0.01 [W/cm$^2$], the temperature may not increase to the first threshold temperature Tl as the threshold temperature of the low-temperature color developing layer 13; and for the power density PDl>15.0 [W/cm$^2$], the temperature may increase too high, so that the medium-temperature color developing layer 15 and the high-temperature color developing layer 17 simultaneously develops color.

The range is set also because of the following reasons: for the scanning speed V1<1.0 [mm/s], the temperature may increase too high due to too much energy applied to an identical position, so that the medium-temperature color developing layer 15 and the high-temperature color developing layer 17 simultaneously develop color; and for the scanning speed V1>90 [mm/s], the temperature may not increase to the threshold temperature (the first threshold temperature Tl) of the low-temperature color developing layer 13.

FIG. 5(*b*) and FIG. 6B illustrate the power density and the scanning speed of the laser light LB to achieve selective color development of the medium-temperature color developing layer 15. For the individual color development of the medium-temperature color developing layer 15, laser scanning is performed with, for example, a power density PDm of 1.0 to 100.0 [W/cm$^2$] and a scanning speed V2 of 10 to 500 [mm/s].

The power density PDm is set to be in this range because of the following reasons: for the power density PDm<1.0 [W/cm$^2$], the temperature may not increase to the second threshold temperature Tm as the threshold temperature of the medium-temperature color developing layer 15; and for the power density PDm>100.0 [W/cm$^2$], the temperature may increase too high, so that the high-temperature color developing layer 17 develops color, and temperature conducted to the low-temperature color developing layer 13 may exceed the threshold temperature (the first threshold temperature Tl), so that the low-temperature color developing layer 13 develops color.

The range is set also because of the following reasons: for the scanning speed V2<10 [mm/s], the temperature may increase too high due to too much energy applied to an identical position, so that the high-temperature color developing layer 17 develops color, and temperature conducted to the low-temperature color developing layer 13 may exceed the threshold temperature (the first threshold temperature Tl), so that the low-temperature color developing layer 13 develops color; and for the scanning speed V2>500 [mm/s], the temperature may not increase to the second threshold temperature Tm as the threshold temperature of the medium-temperature color developing layer 15.

FIG. 5(*c*) and FIG. 6C illustrate the power density and the scanning speed of the laser light LB to achieve selective color development of the high-temperature color developing layer 17. For the individual color development of the high-temperature color developing layer 17, laser scanning is performed with, for example, a power density PDh of 150 to 1000 [W/cm$^2$] and a scanning speed V3 of 750 to 6000 [mm/s].

The power density PDh is set to be in this range because of the following reasons: for the power density PDh<150 [W/cm$^2$], the temperature may not increase to the threshold temperature of the high-temperature color developing layer 17; and for the power density PDh>1000 [W/cm$^2$], the temperature may increase too high, so that the protective layer 18 as a surface layer is thermally damaged, and too much heat generated at the surface layer may cause simultaneous color development of the medium-temperature color developing layer 15 and the low-temperature color developing layer 13 at temperatures exceeding the threshold temperatures (the first threshold temperature Tl and the second threshold temperature Tm) when conducted to these layers.

The range is set also because of the following reasons: for the scanning speed V3<750 [mm/s], the temperature may increase too high due to too much energy applied to an identical position, so that the protective layer 18 as the surface layer is thermally damaged, and too much heat generated at the surface layer may cause simultaneous color development of the medium-temperature color developing layer 15 and the low-temperature color developing layer 13 at temperatures exceeding the threshold temperatures (the first threshold temperature Tl and the second threshold temperature Tm) when conducted to these layers; and for the scanning speed V3>6000 [mm/s], the temperature may not increase to the third threshold temperature Th as the threshold temperature of the high-temperature color developing layer 17.

These power density and scanning speed largely depend on the absorption rate of the energy of the laser light absorbed at the surface layer. In the above-described example, the protective layer as the surface layer is made of a material having an absorption rate of 1% to 50% approximately.

In the above-described configuration, the recording medium is desirably made of any material as described below.

The substrate 12 is made of resin fabricable in a film or a plate, such as polyester resin, polyethylene terephthalate (PET), glycol modified polyester (PET-G), polypropylene (PP), polycarbonate (PC), polyvinyl chloride (PVC), styrene butadiene copolymer (SBR), polyacrylic resin, polyurethane resin, or poly styrene resin.

The resin used for the recording medium may include fillers including a base containing material such as silica, titanium oxide, calcium carbonate, or alumina, provided with whiteness, surface smoothness, thermal insulation, and other properties.

The above-described resins and fillers are examples, and any other material having sufficient fabricability and functionality may be used.

The low-temperature color developing layer 13, the medium-temperature color developing layer 15, and the high-temperature color developing layer 17 each include resin having a high transparency such as polyvinyl alcohol, polyvinyl acetate, or polyacrylic, as a binding agent, and leuco dye, leuco pigment, or any other thermosensitive material, as a color material that develops the three primary colors at a temperature exceeding a certain threshold temperature.

Examples of the leuco dye, leuco pigment, and other thermosensitive material as a color material may include color development dyes such as 3,3-bis(1-n-butyl-2-methylindole-3-yl)phthalide, 7-(1-butyl-2-methyl-1H-indole-3-yl)-7-(4-diethylamino-2-methyl-phenyl)-7H-furo[3,4-b]pyridine-5-one, 1-(2,4-dichloro-phenylcarbamoyl)-3,3-dimethyl-2-oxo-1-phenoxy-butyl-(4-diethylamino-phenyl)-carbamic acid isobutyl ester, 3,3-bis(p-dimethylaminophenyl)phthalide, 3,3-bis(p-dimethylaminophenyl)-6-dimethylaminophthalide (also known as crystal violet lactone=CVL), 3,3-bis(p-dimethylaminophenyl)-6-aminophthalide, 3,3-bis(p-dimethylaminophenyl)-6-nitrophthalide, 3,3-bis 3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 2-(2-fluorophenylamino)-6-diethylamino fluoran, 2-(2-fluorophenylamino)-6-di-n-butyl amino fluoran, 3-piperidino-6-methyl-7-anilinofluoran, 3-(N-ethyl-p-toluidino)-7-(N-methylanilino)fluoran, 3-(N-ethyl-p-toluidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran, 3-N,N-diethylamino-7-o-chloranilinofluoran, rhodamine-B-lactam, 3-methylspirodinaphthopyran, 3-ethylspirodinaphthopyran, and 3-benzilspironaphthopyran.

A color developer may be any acid material used as an electron acceptor in a thermal recording body, such as an inorganic material including activated white clay and acid white clay, inorganic acid, and organic color developer including aromatic carboxylic acid, anhydride or metal salt thereof, organic sulfonic acid, other organic acid, and phenolic compound. The phenolic compound is preferable in particular.

More specific examples of the color developer include bis 3-allyl-4-hydroxyphenylsulfone, polyhydroxystyrene, 3,5-di-t-butylsalicylic acid zinc salt, 3-octyl-5-methyl salicylic acid zinc salt, phenol, phenolic compounds such as 4-phenylphenol, 4-hydroxy acetophenone, 2,2'-dihydroxydiphenyl, 2,2'-methylene bis(4-chlorophenol), 2,2'-methylene bis (4-methyl-6-t-butylphenol), 4,4'-isopropylidene diphenol (also known as bis phenol A), 4,4'-isopropylidene bis(2-chlorophenol), 4,4'-isopropylidene bis(2-methylphenol), 4,4'-ethylene bis(2-methylphenol), 4,4'-thio bis(6-t-butyl-3-methylphenol), 1,1-bis(4-hydroxyphenyl)-cyclohexane, 2,2'-bis(4-hydroxyphenyl)-n-heptane, 4,4'-cyclohexylidene bis(2-isopropylphenol), and 4,4'-sulfonyldiphenol, salts of the phenolic compounds, salicylic anilide, novolac-type phenolic resin, and p-hydroxy benzyl benzoate.

The spacer layers 14 and 16 provided between the color developing layers may be made of, for example, polypropylene (PP), polyvinyl alcohol (PVA), styrene butadiene copolymer (SBR), polystyrene, or polyacrylic material.

The laser used in this embodiment is preferably a laser capable of emitting red or infrared light having strong thermal effect, and preferably has a wavelength band of 800 to 15000 nm. In particular, the laser is preferably a YAG laser, a $YVO_4$ laser, a $CO_2$ laser, or a semiconductor laser, which are used in thermal processing.

The laser light LB of a wavelength band of 800 to 15000 nm is used because of the following reason: for the laser light LB having a wavelength band of smaller than 800 nm, a special layer that absorbs light and converts it into heat needs to be provided on the surface layer to obtain the amount of heat for color development, or other color formers that cause color development by light energy instead of heat need to be used.

The wavelength band is set also because of the following reason: for the laser light LB having a wavelength band of larger than 15000 nm, a lens cannot condense the laser light with a sufficiently small beam waist at a focal point, so that the size of a pixel for recording cannot be set small, which makes it difficult to record an image at a high resolution.

As described above, the first embodiment uses different scanning speeds of the laser for the three primary colors to control the recording time of each color as a color development target and selectively develop the color, thereby achieving a simplified device configuration while maintaining and improving the quality of a record image.

2. Second Embodiment

The first embodiment describes the method of using different scanning speeds of the laser for the three primary colors to control the recording time of each color as a color development target and selectively develop the color. In a second embodiment of the present invention, the recording time is controlled by the number of scans with a constant laser scanning speed instead of different laser scanning speeds.

Figure 7:
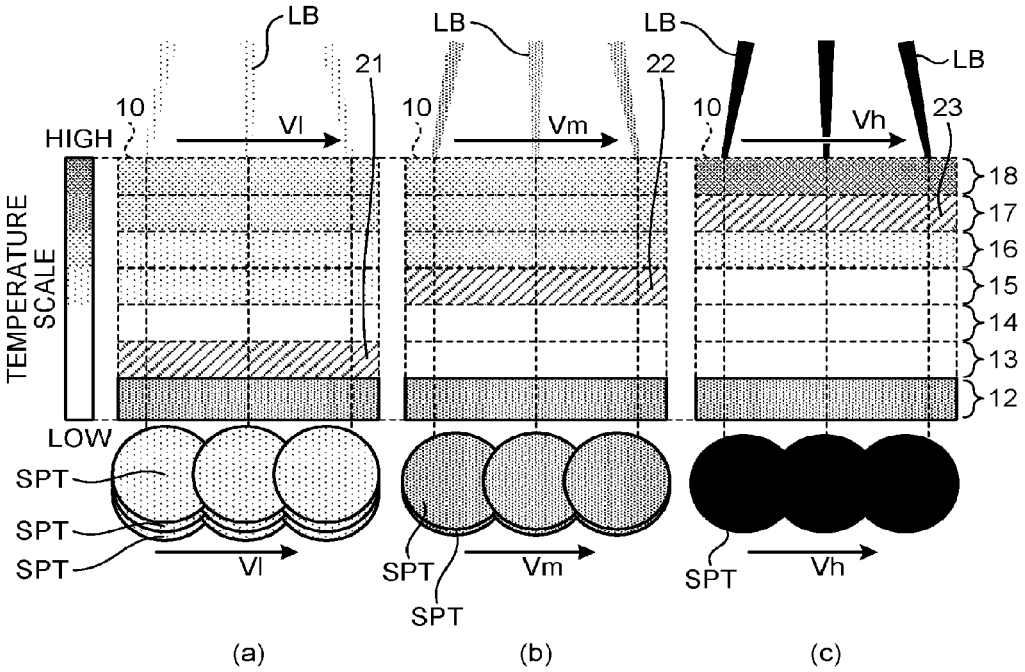
FIG. 7 is an explanatory diagram of a correspondence relation between a diagram of laser irradiation along the section viewed perpendicularly to the stacking direction of the layers in the recording medium and a diagram of irradiation with the laser light LB viewed in the incident direction of the laser light LB.

FIG. 7 is an explanatory diagram of a correspondence relation between a diagram of laser irradiation along the section viewed perpendicularly to the stacking direction of the layers in the recording medium and a diagram of irradiation with the laser light LB viewed in the incident direction of the laser light LB.

In the second embodiment, the recording time for selectively developing the three primary colors is controlled by the number of times (number of scans) to repeat irradiation, whereas the scanning speed of the laser light LB is set to be a constant value in a range of, for example, 10 to 6000 [mm/s].

FIG. 7(*a*) illustrates the power density and the number of scans to achieve selective color development of the low-temperature color developing layer 13. For example, scanning is performed 3 to 50 times at an identical position with a power density of 0.01 to 15.0 [$W/cm^2$] to achieve color development of the low-temperature color developing layer 13.

In FIG. 7, the positions (laser irradiation position) of the laser spots SPT viewed in the incident direction of the laser are illustrated in a vertically shifted manner from each other to facilitate understanding of a difference in the number of scans. In reality, however, laser irradiation is repeatedly placed over at an identical position.

The power density PDl is set to be in the above-described range because of the following reasons: for the power density PDl<0.01 [$W/cm^2$], the temperature may not increase to the threshold temperature (the first threshold temperature Tl) of the low-temperature color developing layer 13; and for the power density PDl>15.0 [$W/cm^2$], the temperature may increase too high, so that the medium-temperature color developing layer 15 and the high-temperature color developing layer 17 simultaneously develop color.

The number of scans, CT1, for the low-temperature color developing layer 13 is set to be in the above-described range because of the following reasons: for the number of scans CT1<3 [times], the temperature may not increase to the threshold temperature (the first threshold temperature Tl) of the low-temperature color developing layer 13; and for the number of scans CT1>50 [times], the temperature may increase too high due to too much energy applied to an identical position, so that the medium-temperature color developing layer 15 and the high-temperature color developing layer 17 simultaneously develop color.

FIG. 7(*b*) illustrates the power density and the number of scans of the laser light LB to achieve selective color development of the medium-temperature color developing layer 15. For example, scanning is performed 1 to 30 times at an identical position with a power density of 1.0 to 100.0 [$W/cm^2$] for the individual color development of the medium-temperature color developing layer 15.

The power density PDm is set to be in this range because of the following reasons: for the power density PDm<1.0 [W/cm$^2$], the temperature may not increase to the threshold temperature (the second threshold temperature Tm) of the medium-temperature color developing layer 15; and for the power density PDm>100.0 [W/cm$^2$], the temperature may increase too high, so that the high-temperature color developing layer 17 develops color, and temperature conducted to the low-temperature color developing layer 13 may exceed the threshold temperature, so that the low-temperature color developing layer 13 develops color.

The number of scans, CT2, for the medium-temperature color developing layer 15 is set to be in the above-described range because of the following reasons: for the number of scans CT2<1 [time], the temperature does not increase to the threshold temperature (the second threshold temperature Tm) of the medium-temperature color developing layer 15; and for the number of scans CT2>30 [times], the temperature may increase too high due to too much energy applied to an identical position, so that the high-temperature color developing layer 17 develops color, and temperature conducted to the low-temperature color developing layer 13 may exceed the threshold temperature (the first threshold temperature Tl), so that the low-temperature color developing layer 13 develops color.

FIG. 7(*c*) illustrates the power density and the number of scans of the laser to achieve selective color development of the high-temperature color developing layer 17. For example, scanning is performed 1 to 10 times at an identical position with a power density of 150 to 1000 [W/cm$^2$] for the individual color development of the high-temperature color developing layer 17.

The power density PDh is set to be in the above-described range because of the following reasons: for the power density PDh<150 [W/cm$^2$], the temperature may not increase to the threshold temperature of the high-temperature color developing layer 17; and for the power density PDh>1000 [W/cm$^2$], the temperature may increase too high, so that the protective layer 18 as the surface layer is thermally damaged, and, too much heat generated at the surface layer may cause simultaneous color development of the low-temperature color developing layer 13 and the medium-temperature color developing layer 15 at temperatures exceeding threshold temperatures (the first threshold temperature Tl and the second threshold temperature Tm) when conducted to these layers.

The number of scans, CT3, for the high-temperature color developing layer 17 is set to be in the above-described range because of the following reasons: for the number of scans CT3<1 [time], the temperature may not increase to the threshold temperature (the third threshold temperature Th) of the high-temperature color developing layer 17; and for the number of scans CT3>10 [times], the temperature may increase too high due to too much energy applied to an identical position, so that the protective layer 18 as the surface layer is thermally damaged, and too much heat generated at the surface layer may cause simultaneous color development of the medium-temperature color developing layer 15 and the low-temperature color developing layer 13 at temperatures exceeding the threshold temperatures (the second threshold temperature Tm and the first threshold temperature Tl) when conducted to these layers.

The second embodiment has the same other configurations and effects as those of the first embodiment.

As described above, the second embodiment applies different numbers of scans of the laser for the three primary colors to control the recording time of each color as a color development target and selectively develop the color, thereby achieving a simplified device configuration while maintaining and improving the quality of a record image.

3. Third Embodiment

The first embodiment describes the method of using different scanning speeds of the laser for the three primary colors to control the recording time of each color as a color development target and selectively develop the color. In a third embodiment of the present invention, the recording time is controlled based on a waiting time (scanning standby time) at scanning with a constant laser scanning speed instead of different laser scanning speeds.

Figure 8:
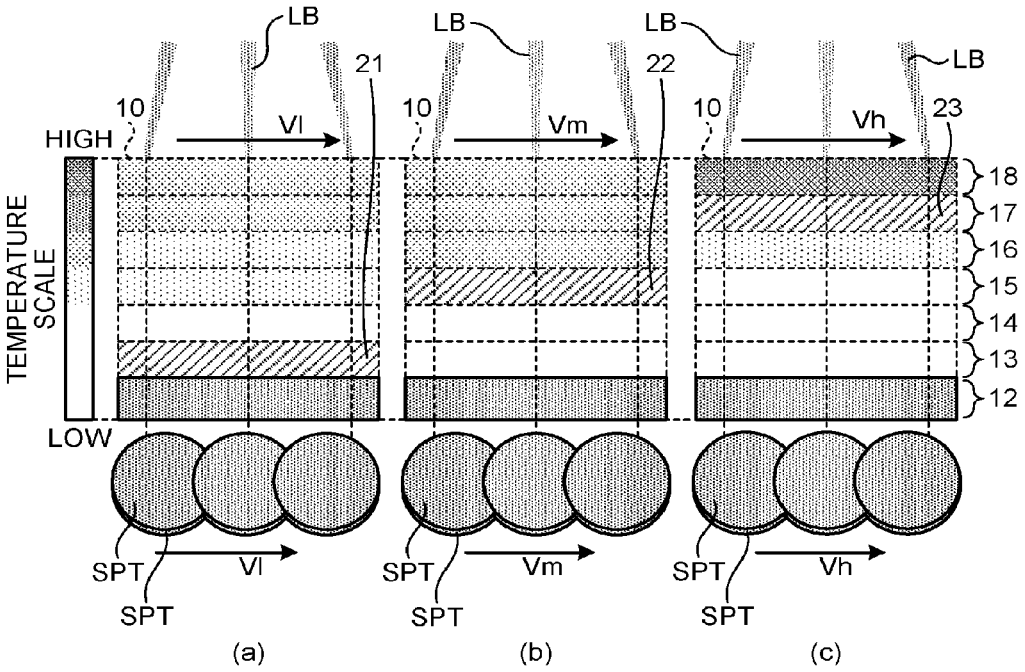
FIG. 8 is an explanatory diagram of a correspondence relation between a diagram of laser irradiation along the section viewed perpendicularly to the stacking direction of the layers in the recording medium and a diagram of irradiation with the laser light LB viewed in the incident direction of the laser light LB.

FIG. 8 is an explanatory diagram of a correspondence relation between a schematic diagram of laser irradiation along the section viewed perpendicularly to the stacking direction of the layers in the recording medium and a diagram of irradiation with the laser light LB viewed in the incident direction of the laser light LB.

As illustrated in FIG. 8, in order to selectively develop the three primary colors, the third embodiment performs control based on a waiting time (scanning standby time) between the n-th scanning and the (n+1)-th scanning in the repetition of laser scanning, and for example, the power density is set to be a constant value in a range of 1 to 20000 [W/cm$^2$], the scanning speed is set to be a constant value in a range of 10 to 6000 [mm/s], and the number of scans is set to be a constant value in a range of 1 to 50.

FIG. 8(*a*) schematically illustrates the power density, the scanning speed, and the number of scans to achieve selective color development of the low-temperature color developing layer 13. Scanning is repeated at an identical position with, for example, a waiting time WT1 of 100 to 100000 [μs] as well as the power density, the scanning speed, and the number of scans described above, for color development of the low-temperature color developing layer 13.

The waiting time WT1 is set to be in the above-described range because of the following reasons: for the waiting time WT1<100 [μs], the temperature may increase too high, so that the medium-temperature color developing layer 15 and the high-temperature color developing layer 17 simultaneously develop color; and for the waiting time WT1>100000 [μs], the temperature of the low-temperature color developing layer 13 may not increase to the threshold temperature.

FIG. 8(*b*) schematically illustrates the power density, the scanning speed, and the number of scans of the laser light LB to achieve selective color development of the medium-temperature color developing layer 15. Scanning is repeated at an identical position with, for example, a waiting time WT2 of 10 to 10000 [μs] as well as the power density, the scanning speed, and the number of scans described above, for the individual color development of the medium-temperature color developing layer 15.

The waiting time WT2 is set to be in the above-described range because of the following reasons: for the waiting time WT1<10 [μs], the temperature may increase too high, so that the high-temperature color developing layer 17 develops color, and, temperature conducted to the low-temperature color developing layer 13 may exceed the threshold temperature, so that the low-temperature color developing layer 13 develops color; and for the waiting time WT2>10000 [μs], the temperature of the medium-temperature color developing layer 15 may not increase to the threshold temperature.

FIG. 8(*c*) schematically illustrates the power density, the scanning speed, and the number of scans of the laser to achieve selective color development of the high-temperature color developing layer 17. Scanning is repeated at an identical position with, for example, a waiting time WT3 of 0.1 to 5000 [μs] as well as the power density, the scanning speed, and the number of scans described above, for the individual color development of the medium-temperature color developing layer 15.

The waiting time WT3 is set to be in the above-described range because of the following reasons: for the waiting time WT1<0.1 [μs], the temperature may increase too high, so that the protective layer 18 as the surface layer is thermally damaged, too much heat generated at the surface layer may cause simultaneous color development of the medium-temperature color developing layer 15 and the low-temperature color developing layer 13 at temperatures exceeding the threshold temperatures when conducted to these layers; and for the waiting time WT3>5000 [μs], the temperature of the high-temperature color developing layer 17 may not increase to the threshold temperature.

The third embodiment has the same other configurations and effects as those of the first embodiment.

As described above, the third embodiment applies different waiting times for the three primary colors at irradiation with the laser light LB to control the recording time of each color as a color development target and selectively develop the color, thereby achieving a simplified device configuration while maintaining and improving the quality of a record image.

4. Modifications of First to Third Embodiments

4.1 First Modification

The scanning speed of the laser light LB, the number of scans with the laser light LB, or the waiting time are controlled individually in the embodiments, but may be controlled in combination.

4.2 Second Modification

Although image recording is performed for each recording dot (pixel) in the above description, a second modification of the embodiments records a plurality of recording dots in a constant recording time, thereby shortening the total recording time to complete image recording processing on the recording medium 10.

In other words, the second modification exploits a time lag from irradiation with the laser light LB to a time at which heat is conducted to each color developing layer, in such a way that, while heat provided on the surface is being conducted to each lower layer (the high-temperature color developing layer 17, the medium-temperature color developing layer 15, and the low-temperature color developing layer 13, in this order), recording is simultaneously proceeded at other recording dot (pixel), thereby shortening the total recording time.

In the second modification, for each recording dot, an identical position is irradiated with the laser light LB once or a plurality of times at a constant period to stably increase temperature to a color development threshold temperature.

Since a suitable irradiation condition of the laser light LB exists for color development of each color, when irradiation with the laser light LB is performed a plurality of times, an optimum period is available for irradiation at the second time or later.

In the second modification, a recording area corresponding to a desired record image is divided into sub recording areas recordable at an optimum period at the second irradiation or later. Recording is performed on each sub recording area followed by recording of the next sub recording area to produce records to be combined to finally obtain a desired image.

In the following description, irradiation conditions to achieve selective color development of a color developing layer (in the present embodiment, the low-temperature color developing layer 13, the medium-temperature color developing layer 15, and the high-temperature color developing layer 17) include:

Laser scanning speed at a recording pixel: Vtem

Laser scanning speed at a non-recording pixel: Ve

Pitch in a sub scanning direction: d

Time period of repetitive irradiation at an identical position of a pixel: Ttem

Information on the record image such as pixels is specified as follows:

The width of the record image in a scanning direction (the width of the recording area in the scanning direction): w The width of the record image in the sub scanning (height) direction (the width of the recording area in the sub scanning direction): H The length of a side of a pixel: R The number of pixels of the record image in the scanning direction: w/R The number of pixels of the record image in the sub scanning direction: H/R Record pixel data of the n-th pixel: $I_n$ Position data of the n-th pixel: $P_n$ The recording time in the unit recording area when recording is performed up to the n-th pixel: $t_n$ The index of an area recordable in a record period T: X The position of the end pixel of the area X: $P_{fX}$ the position of the start pixel of the area X: $P_{sX}$ The distance from $P_{sX}$ to $P_n$: Dn FIG. 9 is an explanatory diagram of numbering of pixels included in an image corresponding to input image data.

In the above-describe information, "the n-th pixel" is a pixel index defined as follows: the first pixel is defined to be the pixel at the upper-left corner of a desired image (rectangular image: corresponding to the recording area) as illustrated in FIG. 9 in the following description; the following pixels are numbered as the second pixel, the third pixel, and so on toward the right; the next pixel of a pixel on the right edge (for example, α-th pixel in the first row) is a pixel on the left edge in the row below (the first pixel in the second row: (α+1)-th pixel).

In the second modification, the low-temperature color developing layer 13 develops color of cyan (C), the medium-temperature color developing layer 15 develops color of magenta (M), and the high-temperature color developing layer 17 develops color of yellow (Y).

In this case, indices c, m, and y are used when color development of the low-temperature color developing layer 13, color development of the medium-temperature color developing layer 15, and color development of the high-temperature color developing layer 17 are to be distinguished. No indices indicate that a description is not limited to any of the color developing layers but is made in general.

Figure 10:
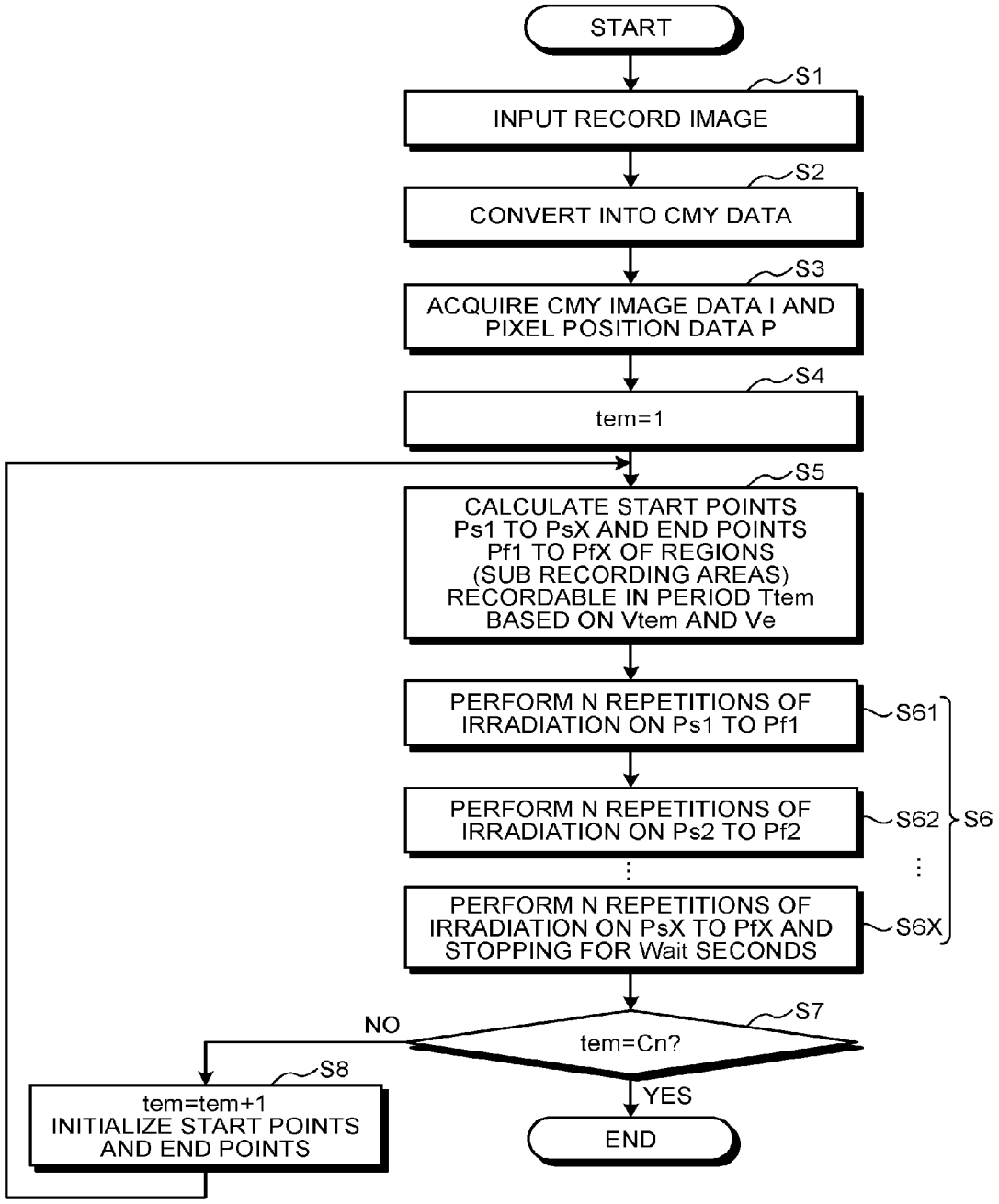
FIG. 10 is a flowchart of processing to shorten the total recording time of laser recording.

FIG. 10 is a flowchart of processing to shorten the total recording time of laser recording.

Figure 11:
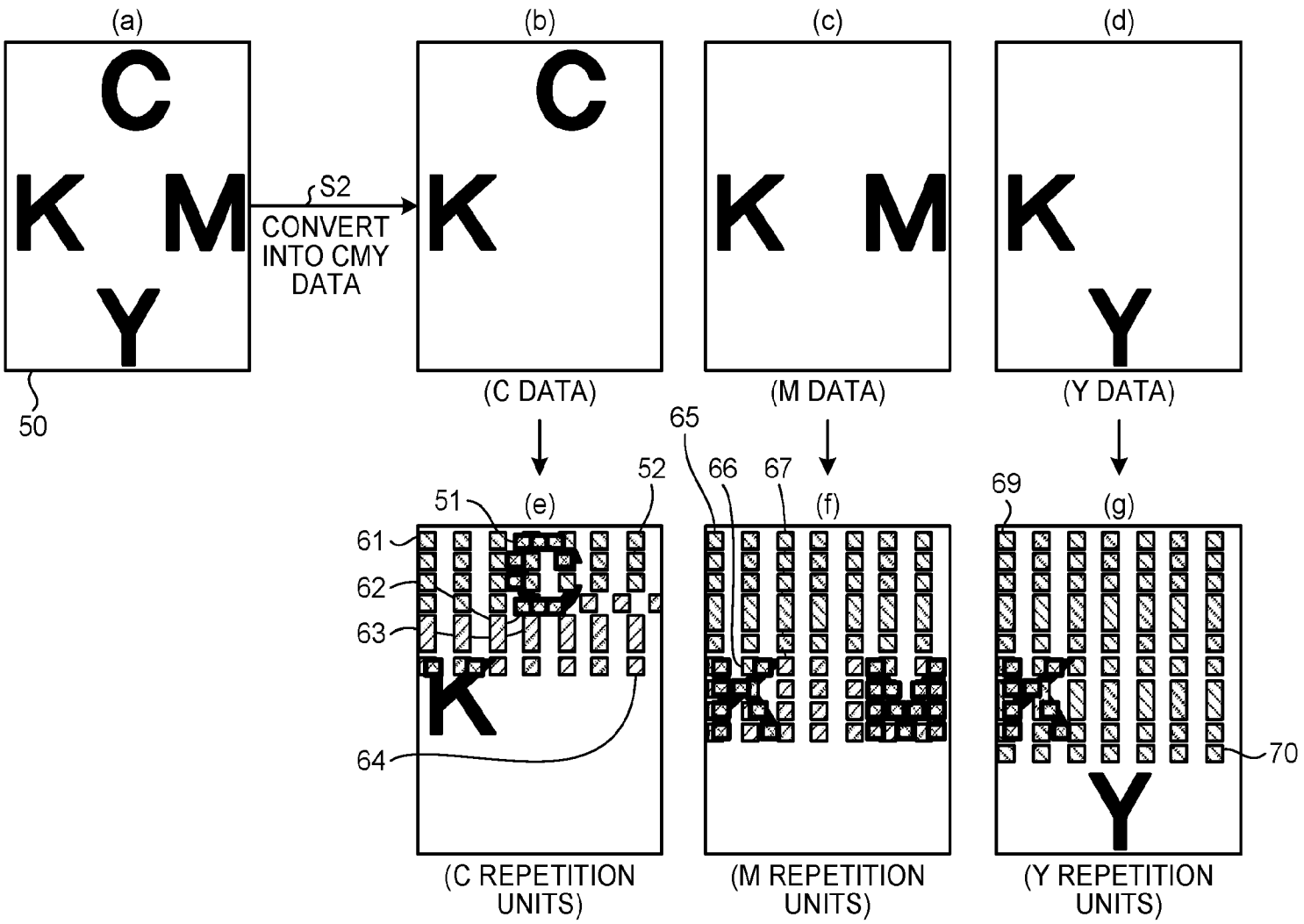
FIG. 11 is an explanatory diagram of determination of a sub recording area according to a second modification of the embodiment.

FIG. 11 is an explanatory diagram of determination of a sub recording area in the second modification.

First, when record image data is input (S1), the controller 104 converts the record image data into CMY data (S2).

In other words, when record image data 50 illustrated in FIG. 11(*a*) is input, the controller 104 converts the record image data 50 into cyan (C) data, magenta (M) data, and yellow (Y) data as illustrated in FIGS. 11(*b*) to 11(*d*). In FIGS. 11(*a*) to 11(*g*), to facilitate understanding, the image corresponding to the record image data includes four images (images of letters C, M, Y, and K) in a single color of cyan, a single color of magenta, a single color of yellow, and black (=C+M+Y).

Next, the controller 104 acquires CMY image data I and pixel position data P based on the cyan data, the magenta data, and the yellow data after the conversion (S3).

Subsequently, the controller 104 sets the variable tem for specifying the record period T to one (S4).

Then, the controller 104 calculates (computes) a plurality of regions (start points $P_{s1}$ to $P_{sX}$ and end points $P_{f1}$ to $P_{fX}$ of a plurality of sub recording areas) recordable in the period Ttem based on the laser scanning speed Vtem at a recording pixel at which recording is performed, and the laser scanning speed Ve at a non-recording pixel at which recording is not performed (S5).

For FIG. 11(*e*), for the cyan data, the controller 104 calculates (computes) a first sub recording area (range between the start point $P_{s1}$ corresponding to the position of a pixel 61 and the end point $P_{f1}$ corresponding to the position of a pixel 62) based on the laser scanning speed Vtem at a recording pixel 51 and the laser scanning speed Ve at a non-recording pixel 52, and a second sub recording area (range between the start point $P_{s2}$ corresponding to the position of a pixel 63 and the end point Pf2 corresponding to the position of a pixel 64).

For FIG. 11(*f*), for the magenta data, the controller 104 calculates (computes) the first sub recording area (range between the start point $P_{s1}$ corresponding to the position of a pixel 65 and the end point $P_{f1}$ corresponding to the position of a pixel 66) and the second sub recording area (range between the start point $P_{s2}$ corresponding to the position of a pixel 67 and the end point $P_{f2}$ corresponding to the position of a pixel 68) based on the laser scanning speed Vtem at a recording pixel and the laser scanning speed Ve at a non-recording pixel.

For FIG. 11(*g*), for the yellow data, the controller 104 calculates (computes) one sub recording area (range between the start point $P_{s1}$ corresponding to the position of a pixel 69 and the end point $P_{f1}$ corresponding to the position of a pixel 70) based on the laser scanning speed Vtem at a recording pixel and the laser scanning speed Ve at a non-recording pixel.

The following provides a detailed description of the calculation (S5) for a plurality of regions recordable in the period Ttem.

Figure 12:
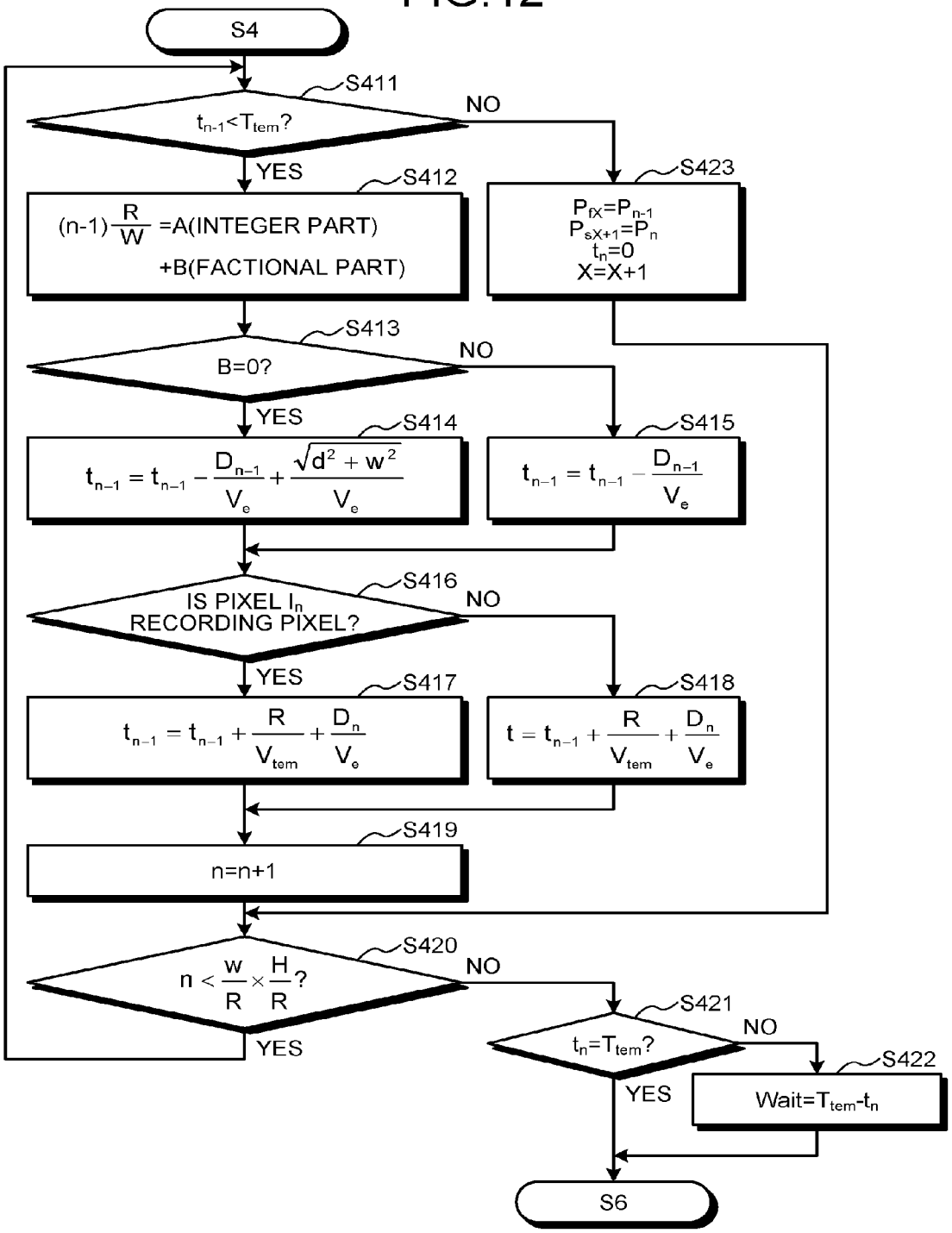
FIG. 12 is a detailed flowchart of calculation of a plurality of regions recordable in a period Ttem in the second modification.

FIG. 12 is a detailed flowchart of the calculation of a plurality of regions recordable in the period Ttem in the second modification.

The second modification exploits a time in which heat provided on the surface of the recording medium 10 by irradiation with the laser light LB for color development of a color developing layer is conducted to the color developing layer. During the time, recording is proceeded on pixels corresponding to other layers. One sub recording area is set as pixels recordable in an optimum irradiation repetition period for color development.

First, the controller 104 determines whether the last set period $t_{n-1}$ is smaller than the period Ttem (S411).

If it is determined at S411 that the period $t_{n-1}$ is equal to or longer than the period Ttem (false) (No at S411), the controller 104 defines pixels up to the (n−1)-th pixel as one sub recording area, sets the n-th pixel to be the start point $P_{sX+1}$ of the next sub recording area, sets $t_n$=0 and X=X+1 for processing at the next area (S423), and then proceeds the process to S420.

If it is determined at S411 that, the last set period $t_{n-1}$ is smaller than the period Ttem (true) (Yes at S411), the controller 104 divides (n−1) by the number of pixels of the record image in the lateral direction to obtain A(integer part)+B(fractional part) of the solution (S412).

Subsequently, the controller 104 determines whether B is equal to zero (S413).

If it is determined at S413 that B is equal to zero (true) (Yes at S413), the controller 104 adds a time necessary for idle running from a pixel on the right edge to a pixel on the bottom left edge to the period $t_{n-1}$ and subtracts a time necessary for idle running from the (n−1)-th pixel to the start point $P_{sX}$ of the area X from the period $t_{n-1}$ (S414), and then proceeds the process to S416.

If it is determined at S413 that B is not equal to zero (false) (No at S413), the controller 104 subtracts, from the period $t_{n-1}$, a time necessary for idle running from the (n−1)-th pixel to the start point $P_{sX}$ of the area X (S415).

Next, the controller 104 determines whether the pixel In is a recording pixel (S416).

If it is determined at S416 that the pixel In is a recording pixel (true) (Yes at S416), the controller 104 substitutes, into the period $t_n$, the sum of a time (R/Vtem) to scan one pixel at the laser scanning speed in the period $t_{n-1}$ and a time necessary for idle running from the n-th pixel to the start point $P_{sX}$ (S417), and then proceeds the process to S419.

If it is determined at S416 that the pixel In is not a recording pixel but is a non-recording pixel (false) (No at S416), the controller 104 substitutes, into the period $t_n$, the sum of a time (R/Ve) for idle running over one pixel in the period $t_{n-1}$ and a time ($D_n/V_e$) necessary for idle running from the n-th pixel to the start point $P_{sX}$ (S418).

Next, the controller 104 adds one to the pixel index n (S419).

Subsequently, the controller 104 determines whether the pixel index n is smaller than the total number of pixels of the record image (S420).

If it is determined at S420 that the pixel index n is smaller than the total number of pixels of the record image (true) (Yes at S420), the controller 104 returns the process back to S411, and repeats the processing at s S411 to S420.

If it is determined at S420 that the pixel index n is equal to or larger than the total number of pixels of the record image (false) (No at S420), the controller 104 determines whether $t_n$ is equal to Ttem at this stage (S421).

If it is determined at S421 that $t_n$ is equal to Ttem at this stage (Yes at S421), the controller 104 proceeds the process to S6 (S61).

If it is determined at S421 that $t_n$ is not equal to Ttem at this stage (false) (No at S421), the controller 104 sets a waiting time Wait to be $t-t_{n-1}$ (S422), and then proceeds the process to S6 (S61).

Subsequently, the controller 104 controls the laser head unit 102 and the driver 103 to perform N repetitions of irradiation of the start point $P_{s1}$ to the end point $P_{f1}$ of a sub recording area (S61), N repetitions (S62) of irradiation of the start point $P_{s2}$ to the end point Pf2 of a sub recording area, . . . , and N repetitions (S6X) of irradiation of the start point $P_{sX}$ to the end point $P_{fX}$ of a sub recording area), and determines whether the variable tem for specifying the record period The is equal to Cn (the number of kinds of color developing layers) (S7).

If it is determined at S7 that the variable tem is smaller than Cn (No at S7), the process is yet to be completed, and thus the controller 104 adds one to the variable tem, initializes the start points $P_{s1}$ to $P_{sX}$ and the end points $P_{f1}$ to $P_{fX}$ (S8), returns the process back to S5, proceeds to processing on the next sub recording area, and then repeats the same processing.

If it is determined at S7 that the variable tem is equal to Cn (Yes at S7), the controller 104 ends the process.

Figure 13:
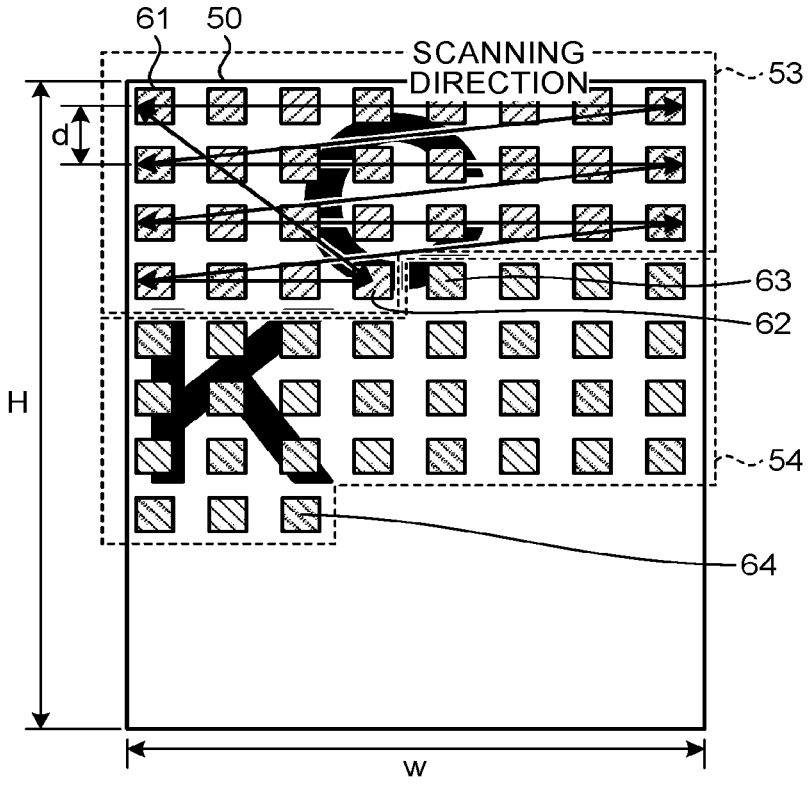
FIG. 13 is an explanatory diagram of an effect of the second modification.

FIG. 13 is an explanatory diagram of an effect of the second modification.

According to the second modification, as illustrated in FIG. 13, since a plurality of sub recording areas 53, 54, . . . are determined in units of pixels, and recording is performed at an identical period for each of the sub recording area 53, 54, . . . , repetitive irradiation can be performed in accordance with the period Ttem when the scanning speed differs between a recording pixel and a non-recording pixel (idle running pixel), and thus areas recordable in the period Ttem can be simultaneously recorded. This configuration achieves a significant reduction in the total recording time while stably providing color development, thereby achieving an improved productivity in recording.

4.3 Third Modification

Similarly to the second modification, in a third modification of the embodiments, a plurality of recording dots (pixels) are recorded in the constant recording time, thereby shortening the total recording time to complete image recording processing on the recording medium 10.

The third modification differs from the second modification in that a sub recording area recordable in the period Ttem is specified not in units of pixels but in rows at a constant interval.

The third modification exploits a time in which heat provided on the surface of the recording medium by laser irradiation for color development of a color developing layer as a recording target is conducted to the color developing layer. During the time, recording is proceeded on pixels corresponding to other layers. The number of rows recordable in an optimum irradiation repetition period for color development is calculated, and the unit recording area is set as an array of rows recorded as one recording area at a constant interval over the entire desired record image.

Similarly to the second modification, the calculation of sub recording areas is performed at S5 in FIG. 10.

Figure 14:
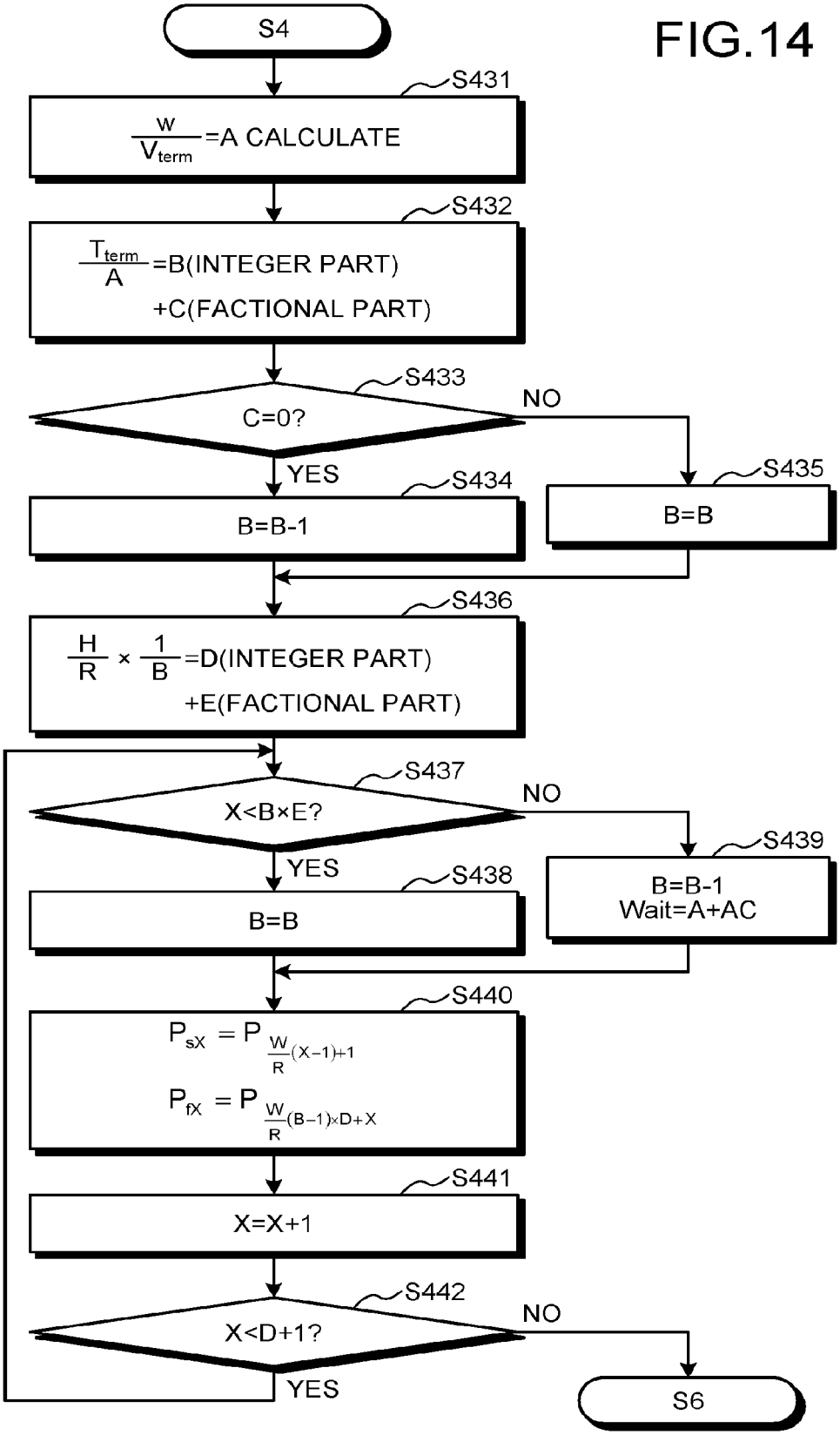
FIG. 14 is a detailed flowchart of calculation of a plurality of regions recordable in the period Ttem according to a third modification of the embodiment.

FIG. 14 is a detailed flowchart of the calculation of a plurality of regions recordable in the period Ttem in the third modification.

Figure 15:
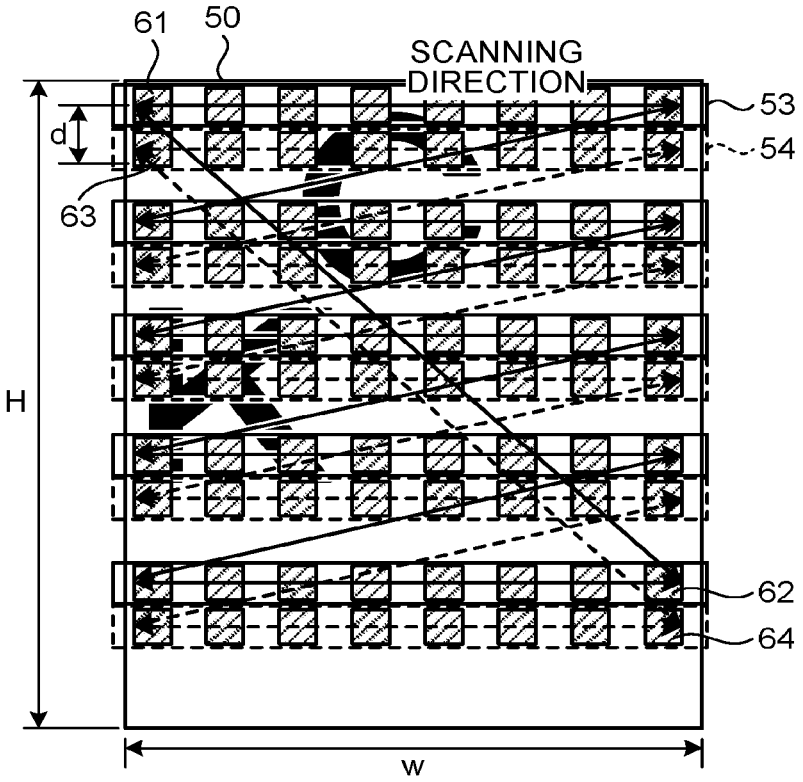
FIG. 15 is an explanatory diagram of determination of a sub recording area in the third modification.

FIG. 15 is an explanatory diagram of determination of a sub recording area in the third modification.

First, assuming that pixels in one row of the image correspond to the input record image data 50 in the width direction are recording pixels, the controller 104 calculates a time necessary for movement by one row in the width direction at the laser scanning speed at a recording pixel and sets the time as A (S431).

Next, the controller 104 calculates the number of rows recordable in the width direction in the period Ttem, and sets the number as B(integer part)+C(fractional part) (S432).

Subsequently, the controller 104 determines whether the fractional part C is equal to zero (S433).

If it is determined at S433 that C is equal to zero (true) (Yes at S433), the controller 104 sets B=B−1 to reduce the number of rows recordable in the period Ttem by one row (S434), and then proceeds the process to S436. This reduction is performed to reliably have a time necessary for idle running from the end point $P_{fX}$ of each recording area to the start point $P_{sX}$ thereof.

If it is determined at S433 that C is not equal to zero (false) (No at S433), the controller 104 sets B=B (S435) and proceeds the processing to S436 without a change of B. The controller 104 then calculates the number of pixels (the total number of rows to be recorded) of the record image in the height direction, and calculates D(integer part)+E(fractional part) obtained by dividing the number of pixels by the number of rows recordable in the period Ttem B (S436).

Next, the controller 104 determines whether the value X indicating the index of the unit recording area is smaller than B×E to determine whether the last row of a sub recording area is out of the desired record image (S437).

If it is determined at S437 that the value X indicating the index of the unit recording area is smaller than B×E (true) (Yes at S437), the controller 104 set B=B without any change (S438), and then proceeds the process to S440.

If it is determined at S437 that the value X indicating the index of the unit recording area is equal to or larger than B×E (false) (No at S437), the controller 104 sets B=B−1 and the waiting time Wait=A+AC (S439).

Next, the controller 104 calculates the pixel indices of the start point $P_{sX}$ and the end point $P_{fX}$ of the X-th sub recording area, and stores therein the start point $P_{sX}$ and the end point $P_{fX}$ (S440).

Next, in order to perform processing on the next sub recording area, the controller 104 sets X=X+1 (S441) and determines whether X is smaller than the sum of the last recording area index D and one (S442).

If it is determined at S442 that X is smaller than the sum of the last recording area index D and one (true) (Yes at S442), the controller 104 returns the process back to S437 to repeat the processing at S437 to S442.

If it is determined at S442 that X is equal to or larger than the sum of the last recording area index D and one (false) (No at S442), the controller 104 proceeds the process to S6 (S61) to perform the same processing as that of the second modification.

According to the third modification, as illustrated in FIG. 15, the sub recording areas 53, 54, . . . are determined in units of rows (in FIG. 15, as a group of every other rows), and recording is performed with a constant interval of rows. Thus, at recording with an identical period for each of the sub recording areas 53, 54, . . . , the third modification can reduce any influence of heat left after recording on adjacent or neighboring rows, and achieves a significant reduction in the total recording time while stably providing color development, thereby achieving an improved productivity in recording.

4.4 Fourth Modification

Figure 16:
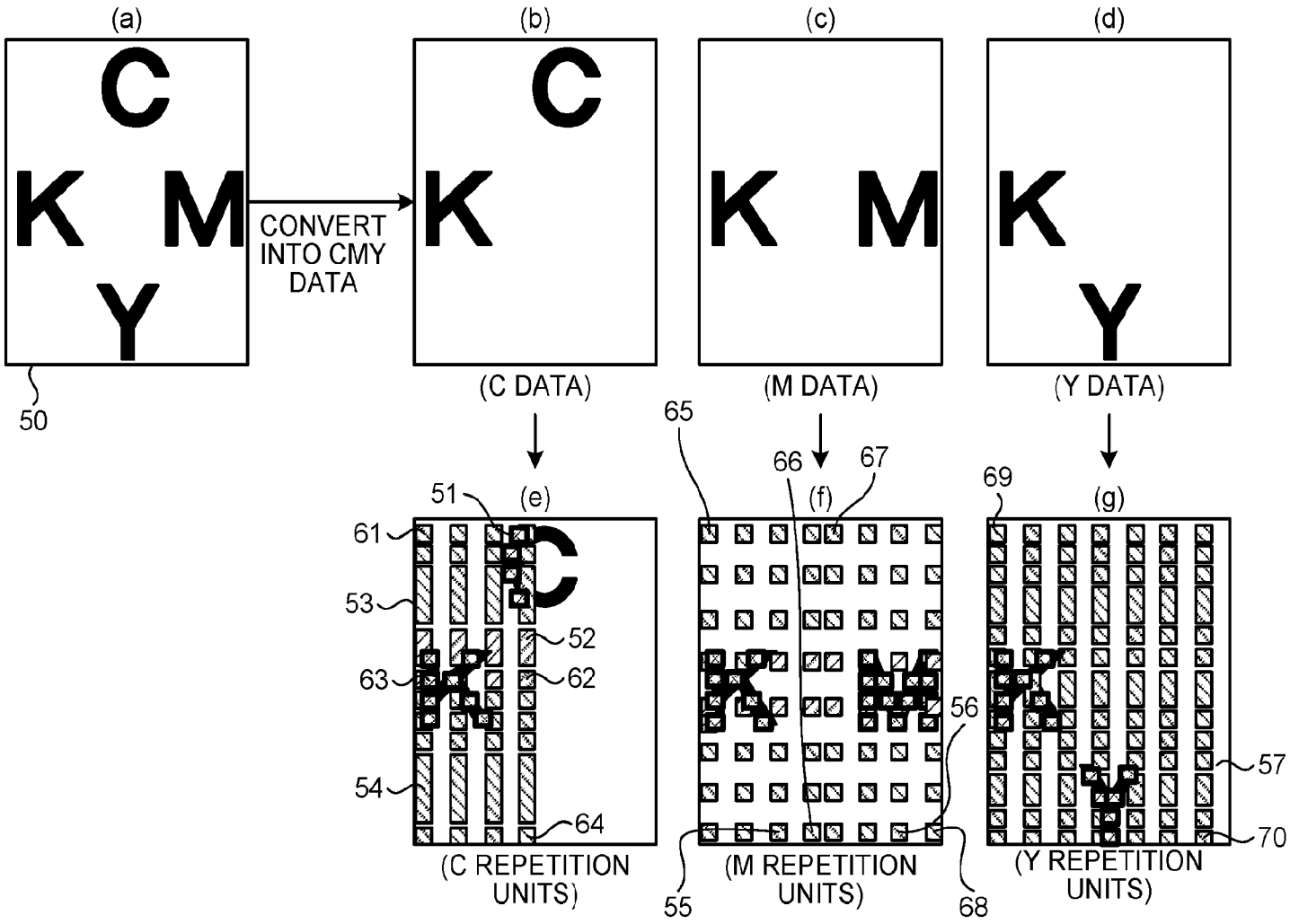
FIG. 16 is an explanatory diagram of an effect of a fourth modification.

FIG. 16 is an explanatory diagram of an effect of a fourth modification of the embodiments.

In the second modification or the third modification described above, sub recording areas are set in units of pixels or in units of rows, as illustrated in FIG. 16, the sub recording areas 53 to 57 can be set through division in the width direction and the height direction.

4.5 Fifth Modification

Figure 17:
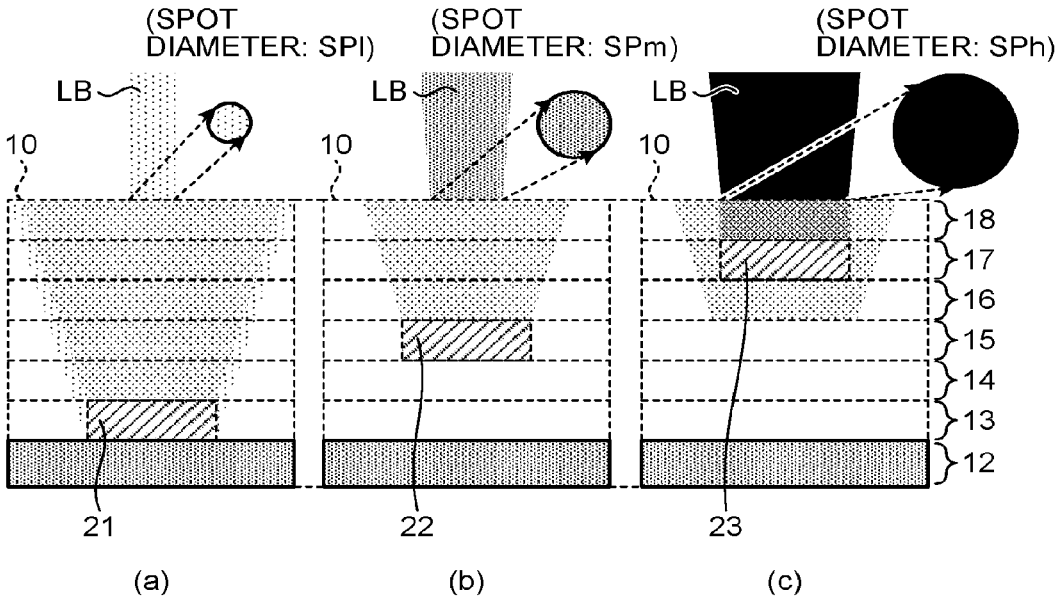
FIG. 17 is an explanatory diagram of a fifth modification of the embodiment.

FIG. 17 is an explanatory diagram of a fifth modification of the embodiments.

Although the spot diameter of laser light at image recording is described above in detail, the spot controller 102A may control the optical system to control the spot diameter of the laser light on the surface of the recording medium so that the spot diameter of the laser light on the surface of the recording medium is further reduced for a color developing layer further away from the surface (in the example of the embodiments described above, the high-temperature color developing layer 17, the medium-temperature color developing layer 15, and the low-temperature color developing layer 13 are further away from the surface in this order), and the size of a recording dot (minimum color development region) in each color developing layer is set to be constant.

More specifically, in order to make the diameter of a color development region the same between the color developing layers, the example of FIG. 17 satisfies the following condition: a spot diameter SPh of the high-temperature color developing layer 17 illustrated in FIG. 17(*c*) at recording>a spot diameter SPm of the medium-temperature color developing layer 15 illustrated in FIG. 17(*b*) at recording>a spot diameter SPl of the low-temperature color developing layer 13 illustrated in FIG. 17(*a*) at recording.

The configuration described above achieves recording of a full color image at a higher resolution.

4.6 Sixth Modification

Although the irradiation time of the laser light LB is controlled in an analog manner in the above description, the irradiation time with the laser light LB may be controlled in a digital manner, in which the laser light is excited with the pulse oscillation, by the number of pulses.

4.7 Seventh Modification

In addition to the above-described control on irradiation with the laser light LB, control through blowing and the heating and cooling of the recording stage 101 may be performed on the environmental temperature of the recording medium 10 itself or its surroundings so as to achieve further improvement in the speed of recording.

4.8 Eighth Modification

Although the case of the three color developing layers is described above, the present invention is similarly applicable to a case of two color developing layers and a case of four or more color developing layers.

4.9 Ninth Modification

The controller 104 of the laser recording device 100 according to the present embodiments includes a control device such as a CPU, a storage device such as a read only memory (ROM) or a RAM, an external storage device such as a HDD or a CD drive device, a display device such as a display, and an input device such as a keyboard or a mouse, and has a hardware configuration utilizing a general computer.

A program executed by the controller 104 of the laser recording device 100 according to the present embodiment is provided as a file recorded in an installable or executable format in a computer-readable recording medium such as a CD-ROM, a flexible disk (FD), a CD-R, or a digital versatile disc (DVD).

The program executed by the controller 104 of the laser recording device 100 according to the present embodiment may be stored on a computer connected with a network such as the Internet and may be provided through download over the network. The program executed by the controller 104 of the laser recording device 100 according to the present embodiment may be provided or distributed over a network such as the Internet.

The program executed by the controller 104 of the laser recording device 100 according to the present embodiment may be stored in advance in, for example, a ROM and provided.

As described above, the laser recording device according to the embodiments is a laser recording device that performs recording by irradiating a recording medium with laser light. The recording medium includes a plurality of thermal recording layers including thermal materials with different color development threshold temperatures and stacked in an ascending order of the threshold temperatures of the included thermal materials from a surface irradiated with the laser light, and an intermediate layer provided between the thermal recording layers to perform thermal insulation and thermal conduction. The laser recording device includes a controller that performs recording on the thermal recording layers as recording targets by irradiation with the laser light having a relatively higher power density at recording of any of the thermal recording layers with a higher threshold temperature or having an effectively longer irradiation time at recording of any of the thermal recording layers with a lower threshold temperature. The embodiment may include the following modes.

In a first mode, when performing recording by irradiation with the laser light a plurality of times at an identical recording position, the controller may divide a recording area into sub recording areas and perform control such that the laser light has an identical irradiation period in the sub recording areas of an identical thermal recording layer.

In a second mode, the laser recording device may include a spot controller that controls the spot diameter of the laser light, and the controller may change the spot diameter of the laser light through the spot controller in accordance with stack positions of the thermal recording layers as recording targets.

In a third mode, the controller may set a larger spot diameter for any of the thermal recording layers stacked closer to the surface irradiated with the laser light so that recording dots formed on the thermal recording layers have an identical size.

In a fourth mode, the laser light may be set to have a wavelength of 800 to 12000 nm.

In a fifth mode, the thermal recording layers in the recording medium may be provided for the respective three primary colors that provide a color expression by subtractive color mixing, and the controller may form a color image based on input image data.

The embodiment may further provide a method executed by a laser recording device that performs recording by irradiating a recording medium with the laser light. The recording medium includes a plurality of thermal recording layers including thermal materials with different color development threshold temperatures and stacked in an ascending order of the threshold temperatures of the included thermal materials from a surface irradiated with the laser light, and an intermediate layer provided between the thermal recording layers to perform thermal insulation and thermal conduction. The method includes setting the laser light having a relatively higher power density at recording of any of the thermal recording layers with a higher threshold temperature, and performing recording on the thermal recording layer as recording targets by irradiation with the laser light having an effectively longer irradiation time at recording of any of the thermal recording layers with a lower threshold temperature.

5. Fourth Embodiment

The laser recording methods according to the first to the third embodiments achieve selective color development of the layers by controlling the irradiation conditions of the laser. In the methods according to the first to the third embodiments, recording is performed for each of the three primary colors, so that at least three scans are needed. In addition, in a case of mixing colors, the number of scans is increased by the number of colors to be mixed, so that recording requires a significant amount of time.

A fourth embodiment of the present invention performs control to achieve a particular condition using the power density, the irradiation time, and the irradiation period of the laser as parameters to simultaneously develop two colors or three colors adjacent in a direction vertical to the incident direction of the laser, thereby reducing the number of scans at recording in a mixed color to shorten the recording time.

The following describes a method of achieving selective color development of a plurality of (in the fourth embodiment, two or three) color developing layers having different color development temperatures and stacked in the stack direction in an order of the color development temperatures by controlling the power density, the irradiation time, and the irradiation period of the laser as appropriate to record a pixel having a mixed color of a plurality of colors among the three primary colors on a recording medium as a stack of the color developing layers in the three primary colors with the different threshold temperatures.

The power, pulse width, scanning speed, delay time (interval time) at repetitions of the irradiation, spot diameter, and defocus amount of the laser may be controlled as appropriate in place of the control on the power density, the irradiation time, and the irradiation period of the laser.

Figure 18:
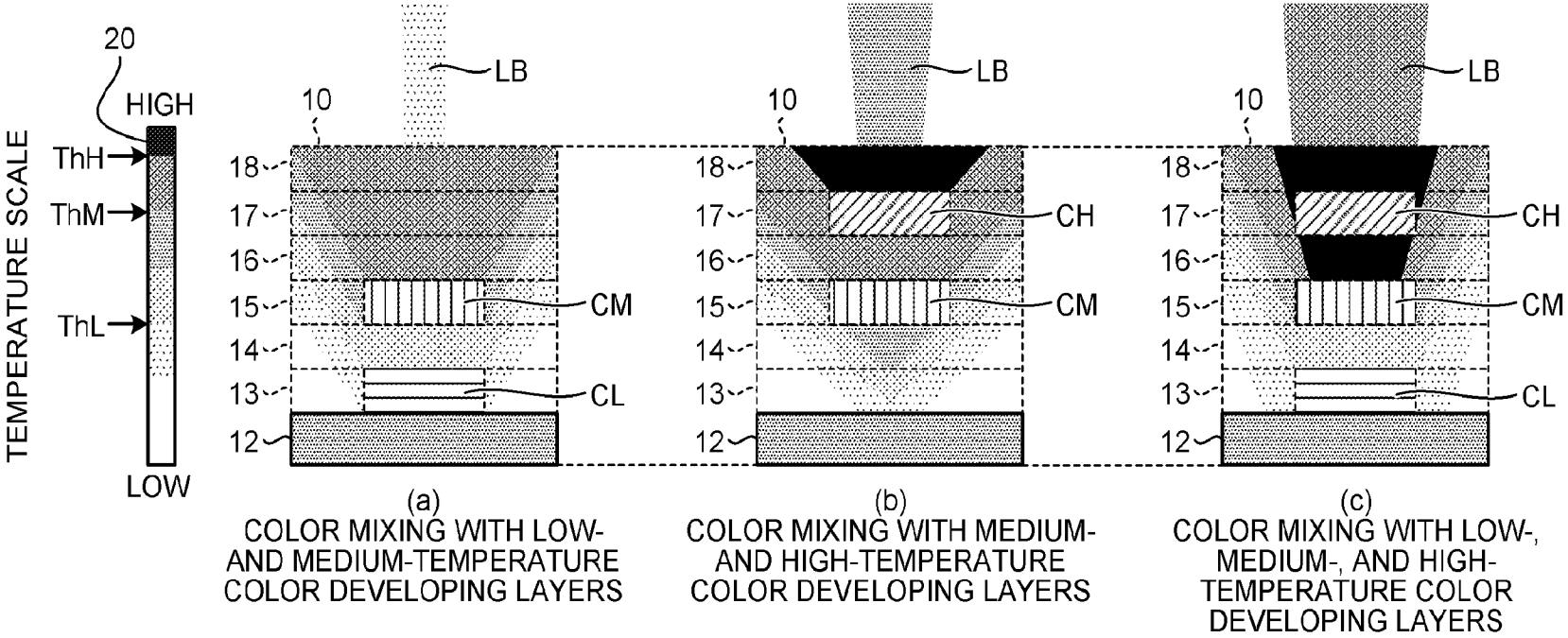
FIG. 18 is an explanatory diagram of a color development principle of color development in a plurality of colors according to a fourth embodiment.

FIG. 18 is an explanatory diagram of a color development principle of color development in a plurality of colors according to the fourth embodiment.

In other words, FIG. 18(*a*) is a principle explanatory diagram of color development of the low-temperature color developing layer 13 and the medium-temperature color developing layer 15 in parallel.

FIG. 18(*b*) is a principle explanatory diagram of color development of the medium-temperature color developing layer 15 and the high-temperature color developing layer 17 in parallel.

FIG. 18(*c*) is a principle explanatory diagram of color development of the low-temperature color developing layer 13, the medium-temperature color developing layer 15, and the high-temperature color developing layer 17 in parallel.

As illustrated in FIG. 18(*a*), color mixing with the low- and the medium-temperature color developing layers can be performed through irradiation with the recording laser light LB under such a particular condition that a color development target region CL in the low-temperature color developing layer 13 exceeds a color development threshold temperature ThL, a color development target region CM in the medium-temperature color developing layer 15 exceeds a color development threshold temperature ThM, and the high-temperature color developing layer 17 does not exceed a color development threshold temperature ThH.

Similarly, as illustrated in FIG. 18(*b*), color mixing with the medium- and the high-temperature color developing layers can be performed through irradiation with the recording laser light LB under such a particular condition that the color development target region CM in the medium-temperature color developing layer 15 exceeds the color development threshold temperature ThM, a color development target region CH in the high-temperature color developing layer 17 exceeds the color development threshold temperature ThH, and the low-temperature color developing layer 13 does not exceed the color development threshold temperature ThL.

Similarly, as illustrated in FIG. 18(*c*), color mixing with the low-, the medium-, and the high-temperature color developing layers can be performed through irradiation with the recording laser light LB under such a particular condition that the color development target region CL in the low-temperature color developing layer 13 exceeds the color development threshold temperature ThL, the color development target region CM in the medium-temperature color developing layer 15 exceeds the color development threshold temperature ThM, and the color development target region CH in the high-temperature color developing layer 17 exceeds the color development threshold temperature ThH.

Figure 19:
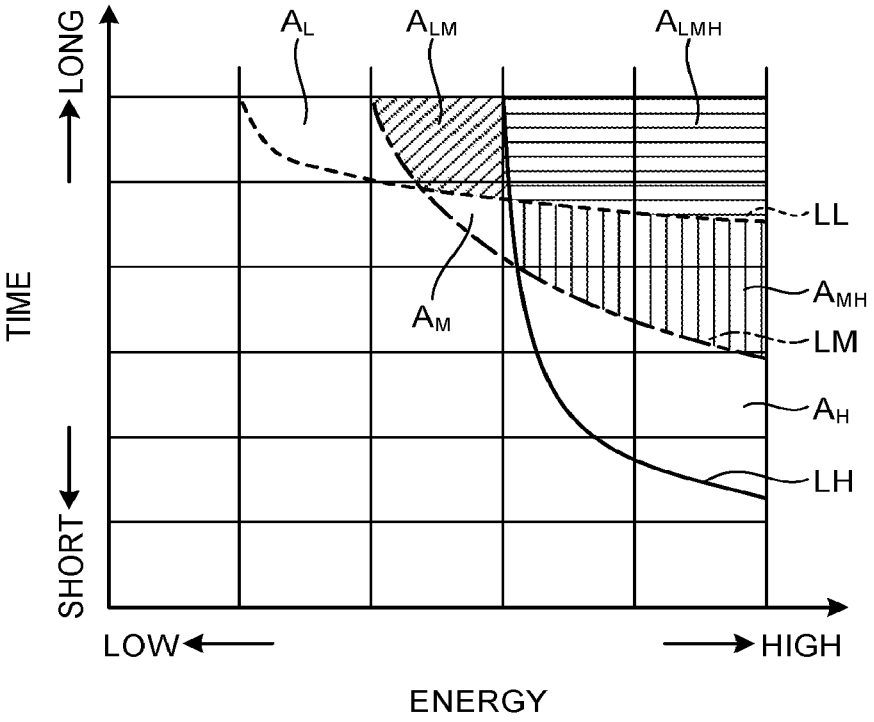
FIG. 19 is an explanatory diagram of an energy-time relation for color developing layers in the fourth embodiment exceeding color development threshold temperatures.

FIG. 19 is an explanatory diagram of an energy-time relation for the color developing layers in the fourth embodiment exceeding the color development threshold temperatures.

FIG. 19 illustrates a curve of a threshold reach time at which a color development target region in each of the color developing layers 13, 15, and 17 reaches the corresponding color development threshold temperature.

Specifically, a threshold reach time curve LL illustrated with a dashed line is an energy-time curve for the low-temperature color developing layer 13 reaching the corresponding color development threshold temperature. The low-temperature color developing layer 13 develops color in a region above the threshold reach time curve LL in FIG. 19.

A threshold reach time curve LM illustrated with a dashed and single-dotted line is an energy-time curve for the medium-temperature color developing layer 15 reaching the corresponding color development threshold temperature. The medium-temperature color developing layer 15 develops color in a region above the threshold reach time curve LM in FIG. 19.

A threshold reach time curve LH illustrated with a solid line is an energy-time curve for the high-temperature color developing layer 17 reaching the corresponding color development threshold temperature. The high-temperature color developing layer 17 develops color in a region above the threshold reach time curve LH in FIG. 19.

Thus, FIG. 19 illustrates that the low-temperature color developing layer 13 and the medium-temperature color developing layer 15 develop color in a region $A_{LM}$ having the left edge defined by the threshold reach time curve LL, the bottom edge defined by the threshold reach time curve LM, and the right edge defined by the threshold reach time curve LH.

FIG. 19 also illustrates that the medium-temperature color developing layer 15 and the high-temperature color developing layer 17 develop color in a region $A_{MH}$ having the left edge defined by the threshold reach time curve LH, the bottom edge defined by the threshold reach time curve LM, and the top edge defined by the threshold reach time curve LL.

FIG. 19 also illustrates that the low-temperature color developing layer 13, the medium-temperature color developing layer 15, and the high-temperature color developing layer 17 develop color in a region $A_{LMH}$ having the left edge defined by the threshold reach time curve LH and the bottom edge defined by the threshold reach time curve LL.

FIG. 19 illustrates that a region $A_L$ having the left edge defined by the threshold reach time curve LL and the right edge defined by the threshold reach time curve LM is a region in which only the low-temperature color developing layer 13 develops color as described in the first embodiment to the third embodiment. FIG. 19 also illustrates that a region $A_M$ having the top edge defined by the threshold reach time curve LL, the bottom edge defined by the threshold reach time curve LM, and the right edge defined by the threshold reach time curve LH is a region in which only the medium-temperature color developing layer 15 develops color as described in the first embodiment to the third embodiment, and that a region $A_H$ having the top edge defined by the threshold reach time curve LM and the bottom edge defined by the threshold reach time curve LH is a region in which only the high-temperature color developing layer 17 develops color as described in the first embodiment to the third embodiment.

The following describes exemplary laser irradiation conditions.

FIG. 20 is an explanatory table of exemplary laser irradiation conditions.

In FIG. 20, Tl(E) [in units of time] represents a function of energy E providing the (low-temperature) threshold reach time curve LL illustrated in FIG. 19, Tm(E) [in units of time] represents a function of energy E providing the (medium-temperature) threshold reach time curve LM, Th(E) [in units of time] represents a function of energy E providing the (high-temperature) threshold reach time curve LH, and T(E) represents a time at which energy is actually provided. Color development of a plurality of color developing layers can be performed simultaneously in parallel through control on laser irradiation under the conditions listed in FIG. 20.

More specifically, the following condition needs to be satisfied to achieve color development of the medium-temperature color developing layer 15 and the high-temperature color developing layer 17:

$$T(E)<Tl(E), \text{ and } T(E)>Tm(E), \text{ and } T(E)>Th(E)$$

The following describes a specific configuration example of the recording medium 10.

FIG. 21 is an explanatory table of the specific configuration example of the recording medium.

The substrate 12 included in the recording medium 10 has, for example, a thickness of 100 μm and a thermal conductivity of 0.01 to 5.00 W/m/K.

The low-temperature color developing layer 13 has, for example, a thickness of 1 to 10 μm and a thermal conductivity of 0.1 to 10 W/m/K.

The first spacer layer 14 has, for example, a thickness of 7 to 100 μm and a thermal conductivity of 0.01 to 1 W/m/K.

The medium-temperature color developing layer 15 has, for example, a thickness of 1 to 10 μm and a thermal conductivity of 0.1 to 10 W/m/K.

The second spacer layer 16 has, for example, a thickness of 1 to 10 μm and a thermal conductivity of 0.01 to 1 W/m/K.

The high-temperature color developing layer 17 has, for example, a thickness of 0.5 to 5 μm and a thermal conductivity of 0.1 to 10 W/m/K.

The protective layer 18 has, for example, a thickness of 0.5 to 5 μm and a thermal conductivity of 0.01 to 1 W/m/K.

5.1 First Mode of Fourth Embodiment

First, the first mode of the fourth embodiment will be described.

Figure 22A:
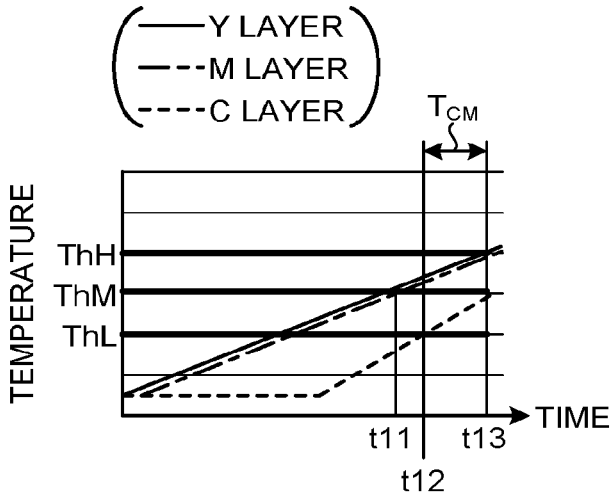
FIGS. 22A to 22C are each an explanatory diagram of a color development method through mixing of a plurality of colors according to a first mode.
Figure 22B:
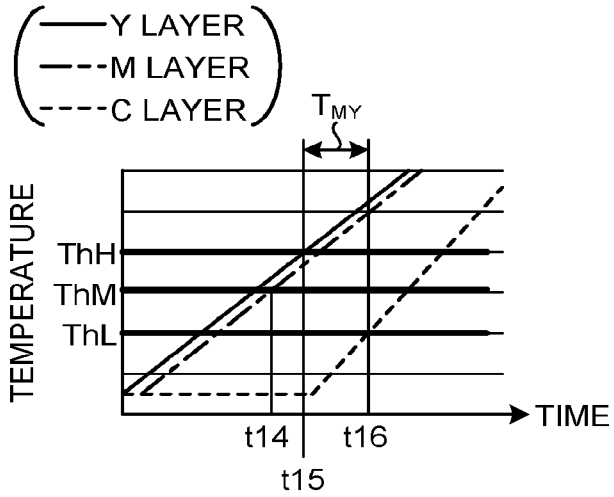
Figure 22C:
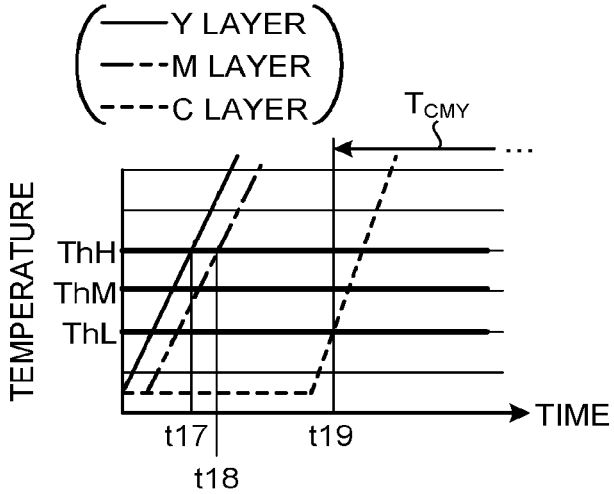

FIGS. 22A to 22C are each an explanatory diagram of a color development method through mixing of a plurality of colors according to the first mode.

FIGS. 22A to 22C illustrate temperature changes of the color developing layers 13, 15, and 17 being irradiated with laser light, when the low-temperature color developing layer 13 is a cyan (C) color developing layer, the medium-temperature color developing layer 15 is a magenta (M) color developing layer, and the high-temperature color developing layer 17 is a yellow (Y) color developing layer.

In this example, a temperature change rate is set by setting (changing) the power density of the laser in accordance with a combination of color developing layers as color development targets.

First, color development in blue (B) will be described.

FIG. 22A illustrates temperature-time curves for color development in blue (B) by irradiation with laser light with a temperature change rate being set for color development of the cyan color developing layer as the low-temperature color developing layer 13 and the magenta color developing layer as the medium-temperature color developing layer 15.

As illustrated in FIG. 22A, the magenta color developing layer as the medium-temperature color developing layer 15 starts color development at time t11.

Color development in blue (B) can be achieved by stopping irradiation with the laser light LB after irradiation up to any time in time TCM beyond time t12, at which the cyan color developing layer as the low-temperature color developing layer 13 starts color development (color development in blue starts), until time t13 right before the yellow color developing layer as the high-temperature color developing layer 17 develops color.

Next, color development in red (R) will be described.

FIG. 22B illustrates temperature-time curves for color development in red (R) by irradiation with laser light with a temperature change rate being set for color development of the magenta color developing layer as the medium-temperature color developing layer 15 and the yellow color developing layer as the high-temperature color developing layer 17.

As illustrated in FIG. 22B, the magenta color developing layer as the medium-temperature color developing layer 15 starts color development at time t14.

Color development in red (R) can be achieved by stopping irradiation with the laser light LB after irradiation up to any time in time TMY beyond time t15, at which the yellow color developing layer as the high-temperature color developing layer 17 starts color development (color development in red starts), until time t16 right before the cyan color developing layer as the low-temperature color developing layer 13 develops color.

Next, color development in black (K) will be described.

FIG. 22C illustrates temperature-time curves for color development in black (K) by irradiation with laser light with a temperature change rate being set for color development of all of the cyan color developing layer as the low-temperature color developing layer 13, the magenta color developing layer as the medium-temperature color developing layer 15, and the yellow color developing layer as the high-temperature color developing layer 17.

As illustrated in FIG. 22C, the yellow color developing layer as the high-temperature color developing layer 17 starts color development at time t17.

Color development in black starts when time passes time t18, at which the magenta color developing layer as the medium-temperature color developing layer 15 starts color development (color development in red starts), and reaches time t19 at which the cyan color developing layer as the low-temperature color developing layer 13 develops color.

Thus, color development in black (K) can be achieved by stopping irradiation with the laser light LB after irradiation up to an appropriate time after time t19.

Figure 23A:
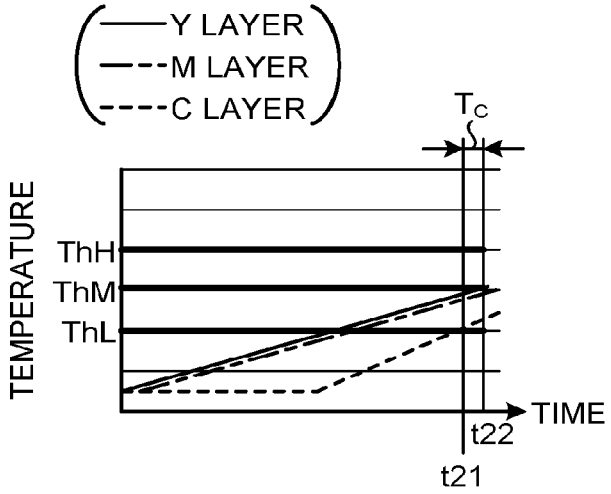
FIGS. 23A to 23C are each an explanatory diagram of a color development method in a single color.
Figure 23B:
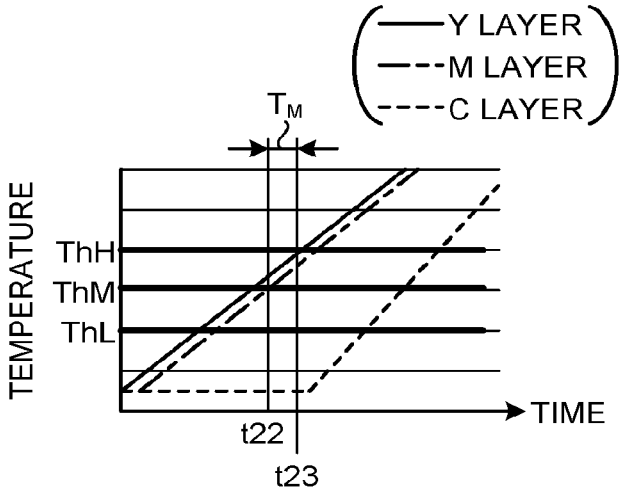
Figure 23C:
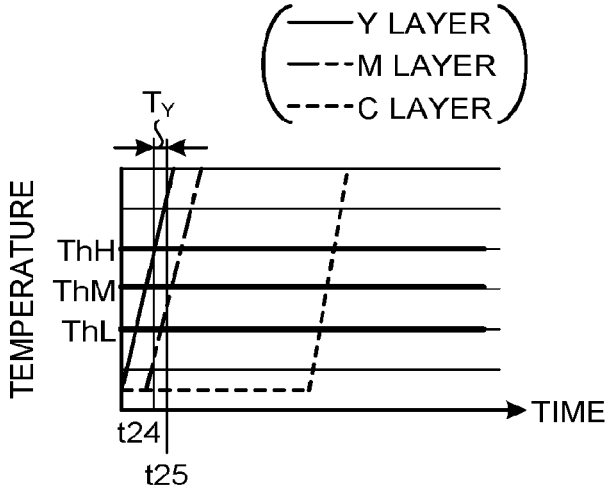

FIGS. 23A to 23C are each an explanatory diagram of a color development method in a single color.

FIGS. 23A to 23C illustrate temperature changes of the color developing layers 13, 15, and 17 being irradiated with laser light, when the low-temperature color developing layer 13 is a cyan (C) color developing layer, the medium-temperature color developing layer 15 is a magenta (M) color developing layer, and the high-temperature color developing layer 17 is a yellow (Y) color developing layer.

Similarly to FIGS. 22A to 22C, a temperature change rate is set by setting (changing) the power density of the laser in accordance with a combination of color developing layers as color development targets.

First, single color development in cyan (C) will be described.

FIG. 23A illustrates temperature-time curves for color development in cyan (C) by irradiation with laser light with a temperature change rate being set for single color development of the cyan color developing layer as the low-temperature color developing layer 13.

As illustrated in FIG. 23A, the cyan color developing layer as the low-temperature color developing layer 13 starts color development at time t21.

Single color development in cyan (C) can be achieved by stopping irradiation with the laser light LB after irradiation up to any time in time TC until time t22 right before the magenta color developing layer as the medium-temperature color developing layer 15 develops color.

Next, single color development in magenta (M) will be described.

FIG. 23B illustrates temperature-time curves for color development in magenta (M) by irradiation with laser light with a temperature change rate being set for single color development of the magenta color developing layer as the medium-temperature color developing layer 15.

As illustrated in FIG. 23B, the magenta color developing layer as the medium-temperature color developing layer 15 starts color development at time t22.

Single color development in magenta (M) can be achieved by stopping irradiation with the laser light LB after irradiation up to any time in time TM until time t23 right before the yellow color developing layer as the high-temperature color developing layer 17 starts color development.

Next, color development in yellow (Y) will be described.

FIG. 23C illustrates temperature-time curves for color development in yellow (Y) by irradiation with laser light with a temperature change rate being set for single color development of the yellow color developing layer.

As illustrated in FIG. 23C, the yellow color developing layer as the high-temperature color developing layer 17 starts color development at time t24.

Single color development in yellow (Y) can be achieved by stopping irradiation with the laser light LB after irradiation up to any time in time TY until time t25 right before the magenta color developing layer as the medium-temperature color developing layer 15 starts color development.

Next, an operation according to the first mode of the fourth embodiment will be described.

Figure 24:
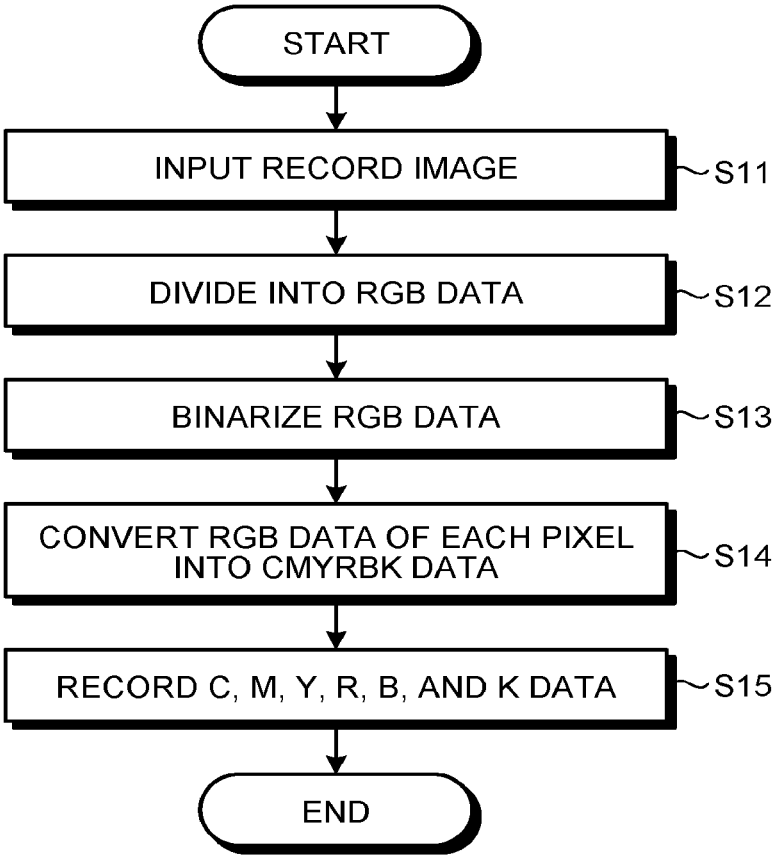
FIG. 24 is a flowchart of an operation according to a first mode of the fourth embodiment.

FIG. 24 is a flowchart of the operation according to the first mode of the fourth embodiment.

First, when the record image data is input (S11), the controller 104 divides (converts) the record image data into RGB data (S12).

Next, the controller 104 binarizes red (R) data, green (G) data, and blue (B) data after the conversion (S13).

Then, the controller 104 converts the binarized RGB data of each pixel into CMYRBK data (S14). Specifically, the RGB data is converted into data in cyan (C), magenta (M), yellow (Y), red (R), blue (B), and black (K). Green (G) is not included in this list because of the following reason: in the fourth embodiment, the cyan color developing layer as the low-temperature color developing layer 13 and the yellow color developing layer as the high-temperature color developing layer 17 are not adjacently stacked with a spacer layer therebetween, and thus simultaneous color development of these layers cannot be performed.

Subsequently, the controller 104 records an image by controlling the laser head unit 102 and the driver 103 to perform color development in cyan (C), magenta (M), yellow (Y), red (R), blue (B), and black (K).

The following provides a detailed description of the processing (S14) of converting the binarized RGB data of each pixel into CMYRBK data.

Figure 25:
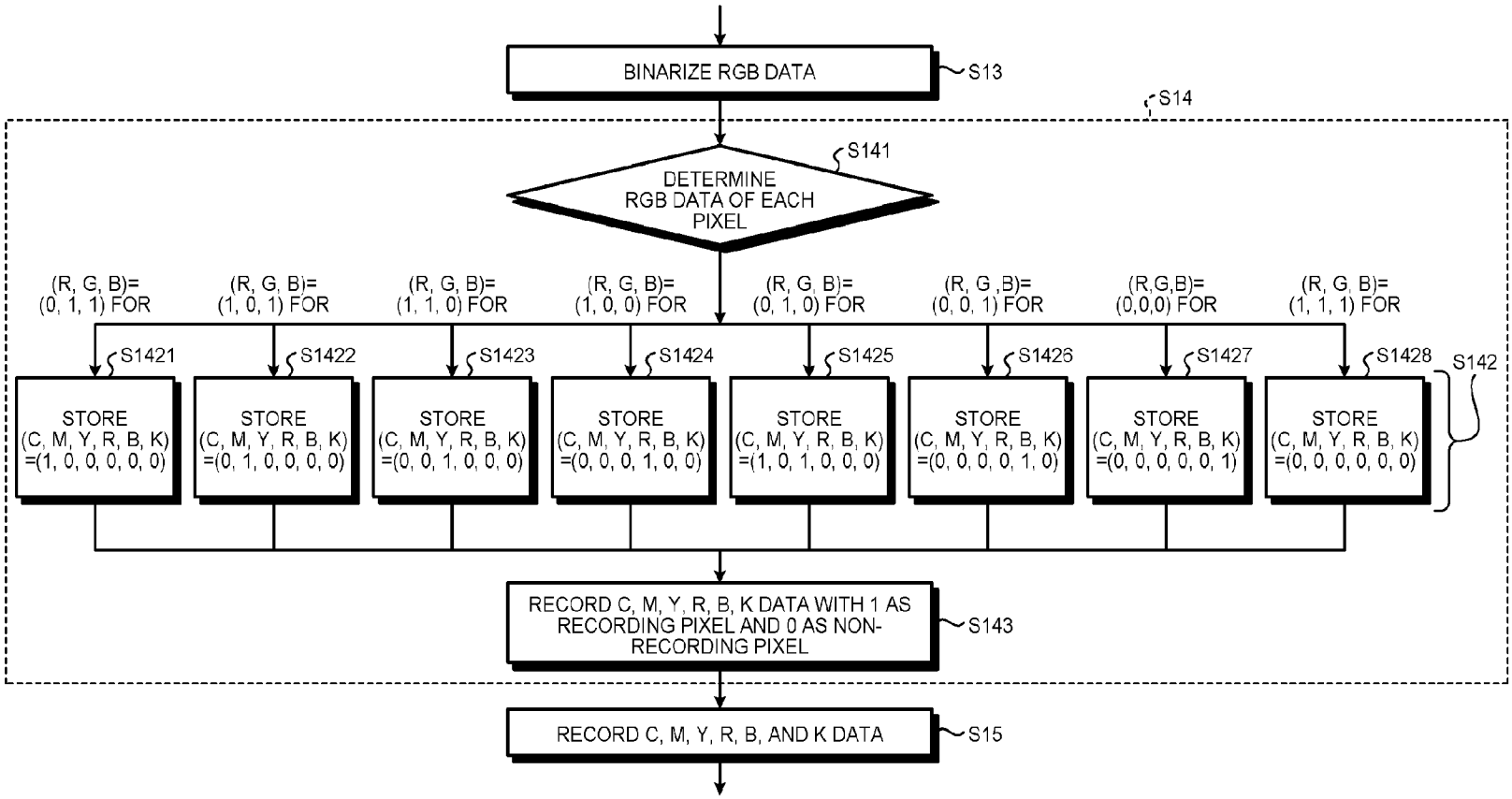
FIG. 25 is a flowchart of a conversion into CMYRBK data.

FIG. 25 is a flowchart of the conversion into CMYRBK data.

In the processing at S14, first, the controller 104 determines (a combination of binarized data of) RGB data of each pixel (S141).

Subsequently, the controller 104 performs the conversion into CMYRBK data as recording data based on the combination of the binarized data of the RGB data (S142).

Specifically, if the combination of the binarized data of the RGB data is (0, 1, 1), in other words, (R, G, B)=(0, 1, 1), the controller 104 sets CMYRBK data as described below (S1421).

(R, G, B)=(0, 1, 1)->(C, M, Y, R, B, K)=(1, 0, 0, 0, 0, 0)

Similarly, if the combination of the binarized data of the RGB data is (1, 0, 1), in other words, (R, G, B)=(1, 0, 1), the controller 104 sets CMYRBK data as described below (S1422).

(R, G, B)=(1, 0, 1)->(C, M, Y, R, B, K)=(0, 1, 0, 0, 0, 0)

If the combination of the binarized data of the RGB data is (1, 1, 0), in other words, (R, G, B)=(1, 1, 0), the controller 104 sets CMYRBK data as described below (S1423).

(R, G, B)=(1, 1, 0)->(C, M, Y, R, B, K)=(0, 0, 1, 0, 0, 0)

If the combination of the binarized data of the RGB data is (1, 1, 0), in other words, (R, G, B)=(1, 0, 0), the controller 104 sets CMYRBK data as described below (S1424).

(R, G, B)=(1, 0, 0)->(C, M, Y, R, B, K)=(0, 0, 0, 1, 0, 0)

If the combination of the binarized data of the RGB data is (0, 1, 0), in other words, (R, G, B)=(0, 1, 0), the controller 104 sets CMYRBK data as described below (S1425).

(R, G, B)=(0, 1, 0)->(C, M, Y, R, B, K)=(1, 0, 1, 0, 0, 0)

If the combination of the binarized data of the RGB data is (0, 0, 1), in other words, (R, G, B)=(0, 0, 1), the controller 104 sets CMYRBK data as described below (S1426).

(R, G, B)=(0, 0, 1)->(C, M, Y, R, B, K)=(0, 0, 0, 0, 1, 0)

If the combination of the binarized data of the RGB data is (0, 0, 0), in other words, (R, G, B)=(0, 0, 0), the controller 104 sets CMYRBK data as described below (S1427).

(R, G, B)=(0, 0, 0)->(C, M, Y, R, B, K)=(0, 0, 0, 0, 0, 1)

If the combination of the binarized data of the RGB data is (1, 1, 0), in other words, (R, G, B)=(1, 1, 1), the controller 104 sets CMYRBK data as described below (S1428).

(R, G, B)=(1, 1, 1)->(C, M, Y, R, B, K)=(0, 0, 0, 0, 0, 0)

This (R, G, B)=(1, 1, 1) represents white, and thus no recording (printing) is needed.

Then, the controller 104 records CMYRBK data with "1" in the CMYRBK data as a recording (printing) pixel and "0" in the CMYRBK data as a non-recording (non-printing) pixel (S143).

The recording as described above enables full-color recording in a short time as compared to recording in single colors.

5.1.1 Modification of First Mode of Fourth Embodiment

Figure 26:
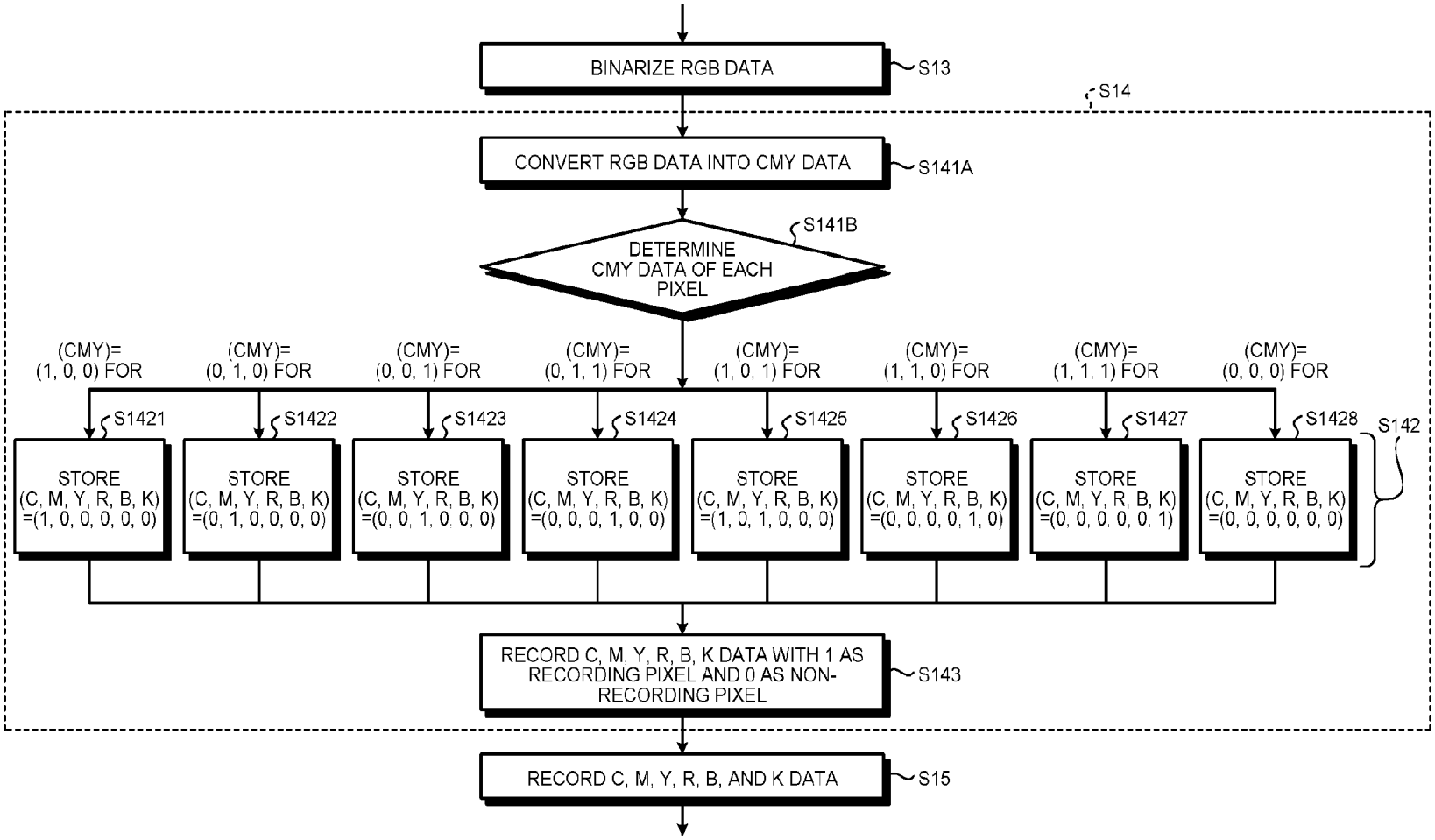
FIG. 26 is a flowchart of an operation according to a modification of the first mode of the fourth embodiment.

FIG. 26 is a flowchart of an operation according to a modification of the first mode of the fourth embodiment.

In FIG. 26, the same parts as those in FIG. 25 are denoted with the same reference symbols. The operation in FIG. 26 differs from that of the first mode in FIG. 25 in that binarized RGB data is converted into CMY data.

In the modification of the first mode of the fourth embodiment, when the record image data is input (S11), the controller 104 divides (converts) the record image data into RGB data (S12).

Next, the controller 104 binarizes red (R) data, green (G) data, and blue (B) data after the conversion (S13).

Then, the controller 104 converts the binarized RGB data of each pixel into CMYRBK data (S14).

Subsequently, the controller 104 records an image by controlling the laser head unit 102 and the driver 103 to perform color development in cyan (C), magenta (M), yellow (Y), red (R), blue (B), and black (K).

The following provides a detailed description of the processing (S14) of converting the binarized RGB data of each pixel into CMYRBK data.

In the processing at S14, first, the controller 104 converts the RGB data into CMY data (S141A).

Subsequently, the controller 104 determines (a combination of binarized data of) the CMY data of each pixel (S141B).

Subsequently, the controller 104 performs the conversion into CMYRBK data as recording data based on the combination of the binarized data of the CMY data (S142A).

Specifically, if the combination of the binarized data of the CMY data is (1, 0, 0), in other words, (C, M, Y)=(1, 0, 0), the controller 104 sets CMYRBK data as described below (S1421).

(C, M, Y)=(1, 0, 0)->(C, M, Y, R, B, K)=(1, 0, 0, 0, 0, 0)

Similarly, if the combination of the binarized data of the CMY data is (0, 1, 0), in other words, (C, M, Y)=(0, 1, 0), the controller 104 sets CMYRBK data as described below (S1422).

(C, M, Y)=(0, 1, 0)->(C, M, Y, R, B, K)=(0, 1, 0, 0, 0, 0)

If the combination of the binarized data of the CMY data is (0, 0, 1), in other words, (C, M, Y)=(0, 0, 1), the controller 104 sets CMYRBK data as described below (S1423).

(C, M, Y)=(0, 0, 1)->(C, M, Y, R, B, K)=(0, 0, 1, 0, 0, 0)

If the combination of the binarized data of the CMY data is (0, 1, 1), in other words, (C, M, Y)=(0, 1, 1), the controller 104 sets CMYRBK data as described below (S1424).

(C, M, Y)=(0, 1, 1)->(C, M, Y, R, B, K)=(0, 0, 0, 1, 0, 0)

If the combination of the binarized data of the CMY data is (1, 0, 1), in other words, (C, M, Y)=(1, 0, 1), the controller 104 sets CMYRBK data as described below (S1425).

(C, M, Y)=(1, 0, 1)->(C, M, Y, R, B, K)=(1, 0, 1, 0, 0, 0)

If the combination of the binarized data of the CMY data is (1, 1, 0), in other words, (C, M, Y)=(1, 1, 0), the controller 104 sets CMYRBK data as described below (S1426).

(C, M, Y)=(1, 1, 0)->(C, M, Y, R, B, K)=(0, 0, 0, 0, 1, 0)

If the combination of the binarized data of the CMY data is (1, 1, 1), in other words, (C, M, Y)=(1, 1, 1), the controller 104 sets CMYRBK data as described below (S1427).

(C, M, Y)=(1, 1, 1)->(C, M, Y, R, B, K)=(0, 0, 0, 0, 0, 1)

If the combination of the binarized data of the CMY data is (0, 0, 0), in other words, (C, M, Y)=(0, 0, 0), the controller 104 sets CMYRBK data as described below (S1428).

(C, M, Y)=(0, 0, 0)->(C, M, Y, R, B, K)=(0, 0, 0, 0, 0, 0)

This is because (C, M, Y)=(0, 0, 0) represents white, and thus no recording (printing) is needed.

Then, the controller 104 records CMYRBK data with "1" in the CMYRBK data as a recording (printing) pixel and "0" in the CMYRBK data as a non-recording (non-printing) pixel (S143).

In the present modification, the recording as described above enables full-color recording in a short time as compared to recording in single colors.

5.2 Second Mode of Fourth Embodiment

The following describes an operation according to the second mode of the fourth embodiment.

Figure 27:
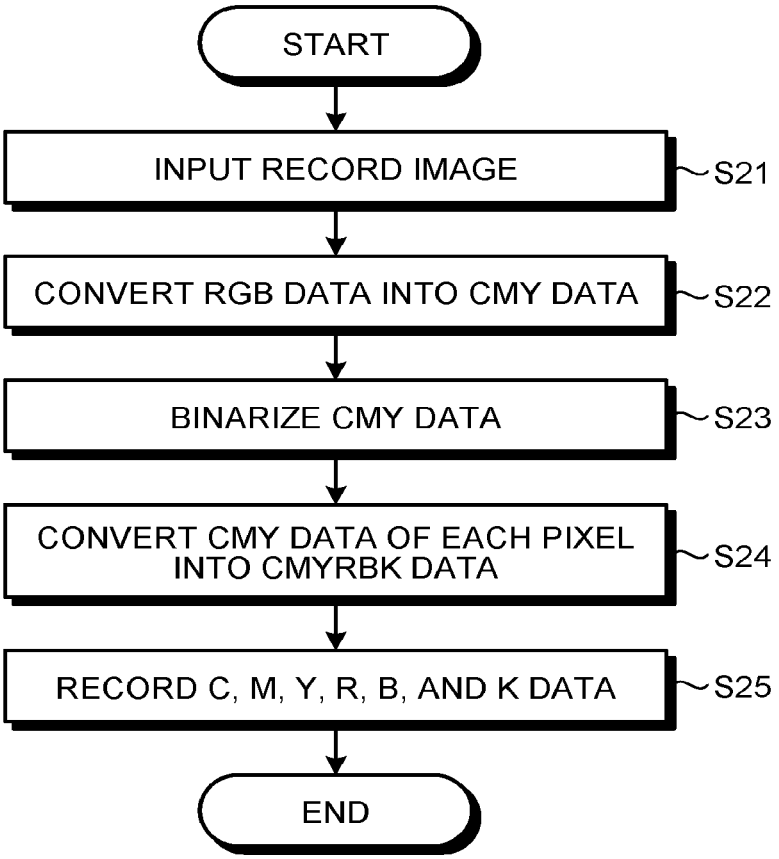
FIG. 27 is a flowchart of an operation according to a second mode of the fourth embodiment.

FIG. 27 is a flowchart of the operation according to the second mode of the fourth embodiment.

First, when the record image data in the RGB data format is input (S21), the controller 104 converts the RGB data into CMY data (S22).

Next, the controller 104 binarizes C (cyan) data, M (magenta) data, and Y (yellow) data after the conversion (S23).

Then, the controller 104 converts the binarized CMY data of each pixel into CMYRBK data (S24). Specifically, the CMY data is converted into data in cyan (C), magenta (M), yellow (Y), red (R), blue (B), and black (K).

Subsequently, the controller 104 records an image by controlling the laser head unit 102 and the driver 103 to perform color development in cyan (C), magenta (M), yellow (Y), red (R), blue (B), and black (K) (S25).

The following provides a detailed description of the conversion (S24) of the binarized CMY data of each pixel into CMYRBK data.

Figure 28:
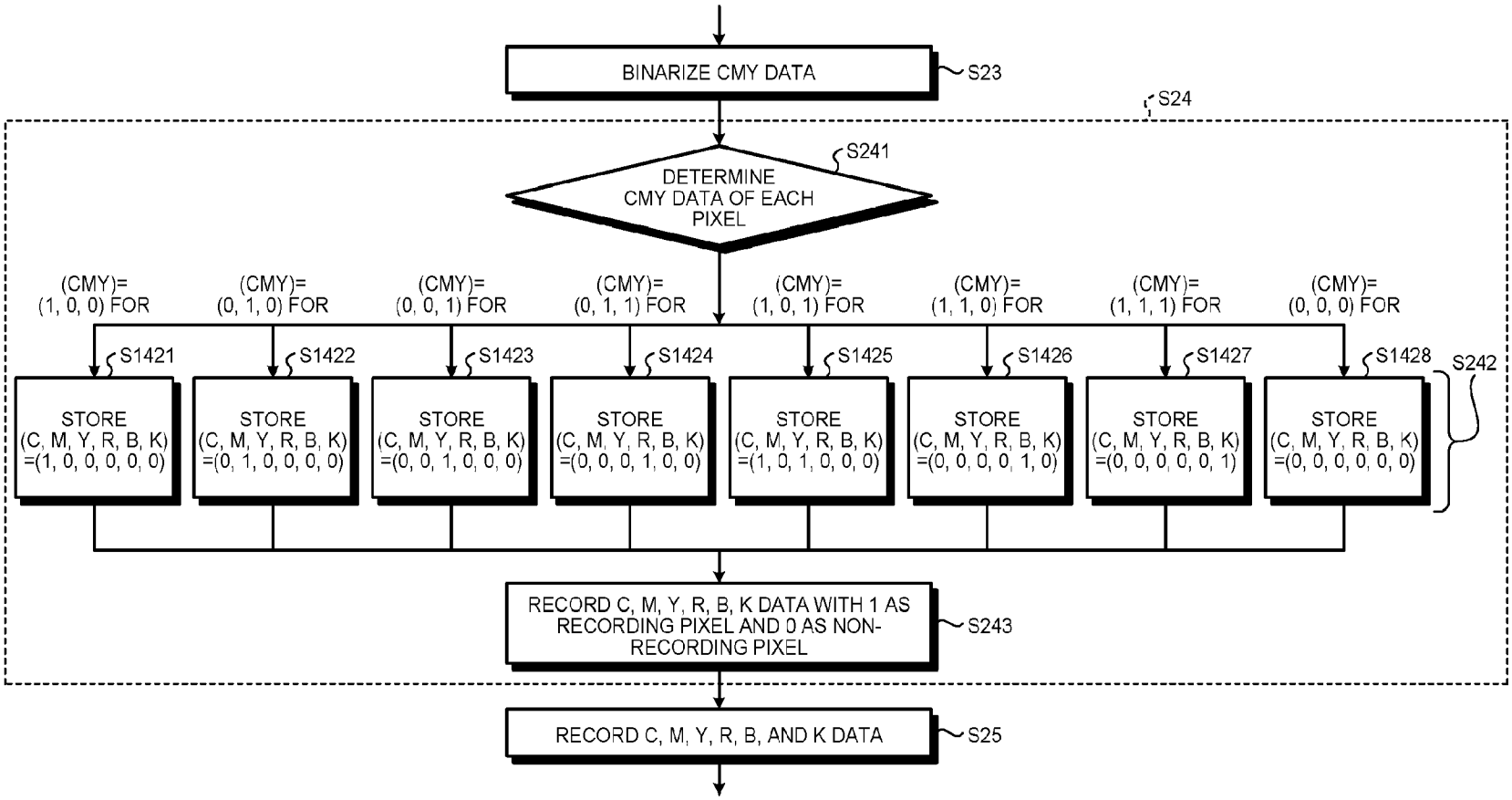
FIG. 28 is a flowchart of a conversion into CMYRBK data.

FIG. 28 is a flowchart of the conversion into CMYRBK data.

In FIG. 28, the same parts as those in FIG. 26 are denoted by the reference symbols, and the detailed description thereof is referred to as needed.

In the processing at S24, first, the controller 104 determines (a combination of binarized data of) the CMY data of each pixel (S241).

Subsequently, the controller 104 performs the conversion into CMYRBK data as recording data based on the combination of the binarized data of the CMY data (S242).

Then, similarly to the modification of the first mode of the fourth embodiment, the controller 104 performs the processing at S1421 to S1425 and S143.

In the second mode of the fourth embodiment, the recording as described above enables full-color recording in a short time as compared to recording in single colors.

6. Fifth Embodiment

Next, a fifth embodiment of the present invention will be described.

Figure 29:
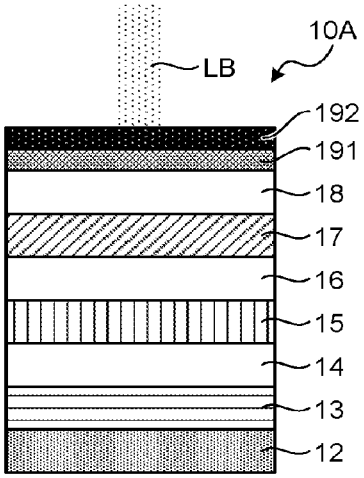
FIG. 29 is a schematic explanatory diagram of the configuration of a recording medium according to a fifth embodiment.

FIG. 29 is a schematic explanatory diagram of the configuration of a recording medium used in the fifth embodiment.

As illustrated in FIG. 1, this recording medium 10A includes, on the substrate 12, a stack of the low-temperature color developing layer 13, the first spacer layer 14, the medium-temperature color developing layer 15, the second spacer layer 16, the high-temperature color developing layer 17, the protective layer 18, a release layer 191, and a light/heat conversion layer 192 in this order. The substrate 12, the low-temperature color developing layer 13, the first spacer layer 14, the medium-temperature color developing layer 15, the second spacer layer 16, the high-temperature color developing layer 17, and the protective layer 18 are the same as those in the embodiments described above.

In the above-described configuration, the release layer 191 is provided to release the light/heat conversion layer 192 after recording is completed.

The light/heat conversion layer 192 absorbs visible light to convert this light into thermal energy. The light/heat conversion layer 192 preferably includes pigment or dye of a color including a complementary color of the laser LB to efficiently absorb the laser LB. Alternatively, the light/heat conversion layer 192 may include a component such as carbon black that is black and absorbs any visible light.

With this configuration, according to the fifth embodiment, laser having a shorter wavelength can be used at recording by the laser LB, thereby reducing the minimum spot diameter at condensation to achieve an increased resolution and thus a high definition.

7. Sixth Embodiment

The embodiments in which the conversion into CMYRBK data is performed before image recording are described above. In a sixth embodiment of the present invention, a conversion into CMYRGBK data additionally including green (G) is performed.

The principle of the sixth embodiment will be first described.

In the recording media 10 and 10A described above, when the laser LB is controlled with a constant power density or a constant irradiation period, it is impossible to perform control to achieve color development of the low-temperature color developing layer 13 and the high-temperature color developing layer 17 but not color development of the medium-temperature color developing layer 15.

In the sixth embodiment, for example, the power density, the irradiation period, and the irradiation time of the laser LB are modulated not to achieve color development of the medium-temperature color developing layer 15.

Figure 30:
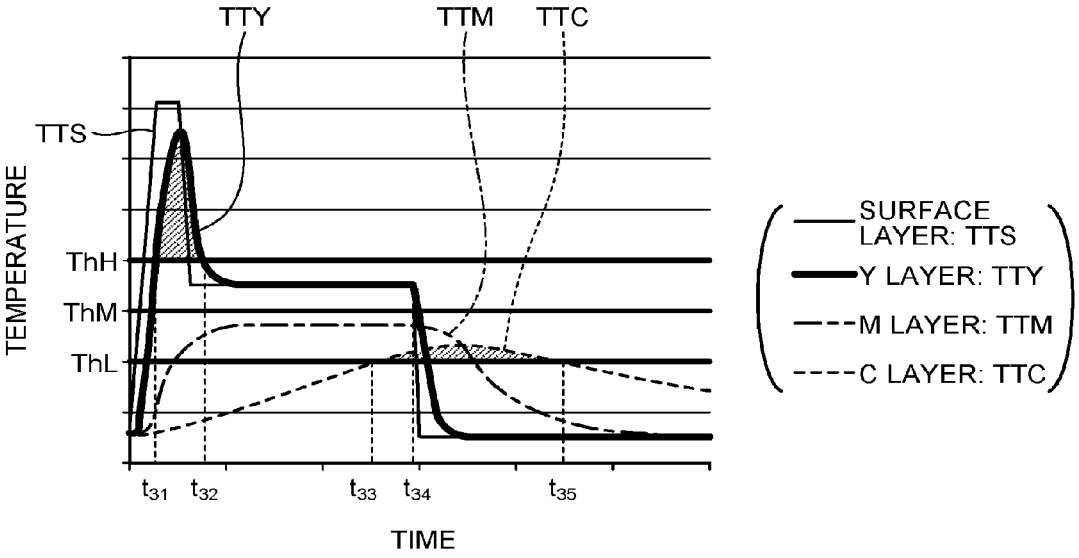
FIG. 30 is an explanatory diagram of recording control according to a sixth embodiment.

FIG. 30 is an explanatory diagram of recording control according to the sixth embodiment.

Specifically, as illustrated in FIG. 30, color development is achieved by changing the temperature of the surface layer of the recording medium 10 (the surface layer of the protective layer 18) as illustrated with the temperature curve TTS to change the temperature of the high-temperature color developing layer 17 as illustrated with the temperature curve TTY so that the temperature of the high-temperature color developing layer 18 exceeds the threshold temperature ThH as illustrated in a range of time t31 to time t32.

In a range of time t32 to time t34, the temperature of the surface layer of the recording medium 10 is set to be a predetermined temperature between the threshold temperature ThH and the threshold temperature ThM. Accordingly, the temperature of the medium-temperature color developing layer 15 is set to be a predetermined temperature between the threshold temperature ThM and the threshold temperature ThC as illustrated with the temperature curve TTM, and the medium-temperature color developing layer 15 does not develop color.

The temperature of the low-temperature color developing layer 13 exceeds the threshold temperature ThL at time t33 as illustrated with the temperature curve TTC.

Simultaneously, the temperature of the high-temperature color developing layer 17, the temperature of the medium-temperature color developing layer 15, and the temperature of the low-temperature color developing layer 13 are gradually decreased by controlling the laser LB so that the temperature of the surface layer of the recording medium 10 is lower than the threshold temperature ThL at time t34, and the temperature of the low-temperature color developing layer 13 falls below the threshold temperature ThL as illustrated with the temperature curve TTC at time t35, which ends recording.

Accordingly, color development in G (green) can be performed by preventing color development of only the medium-temperature color developing layer 15 through irradiation control on the laser LB and temperature control on the recording medium 10.

The following describes an operation according to the sixth embodiment.

Figure 31:
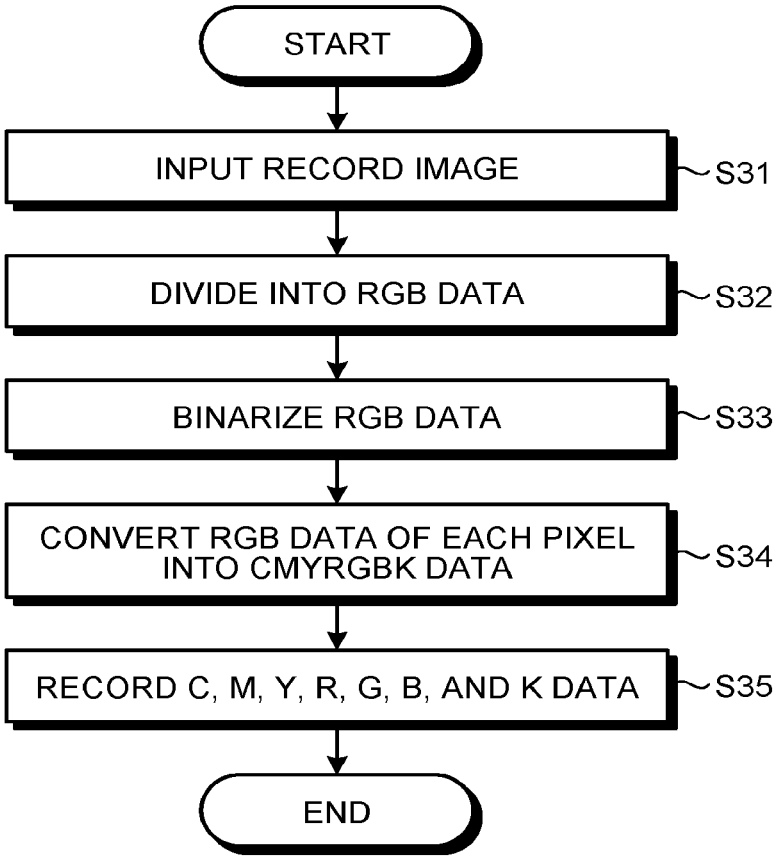
FIG. 31 is a flowchart of an operation in the sixth embodiment.

FIG. 31 is a flowchart of the operation according to the sixth embodiment.

First, when the record image data is input (S31), the controller 104 divides (converts) the record image data into RGB data (S32).

Next, the controller 104 binarizes red (R) data, green (G) data, and blue (B) data after the conversion (S33).

Then, the controller 104 converts the binarized RGB data of each pixel into CMYRGBK data (S34). Specifically, the RGB data is converted into data in cyan (C), magenta (M), yellow (Y), red (R), green (G), blue (B), black (K).

Subsequently, the controller 104 records an image by controlling the laser head unit 102 and the driver 103 to perform color development in cyan (C), magenta (M), yellow (Y), red (R), green (G), blue (B), and black (K) (S35).

The following provides a detailed description of the conversion of the binarized RGB data of each pixel into CMYRGBK data (S14).

Figure 32:
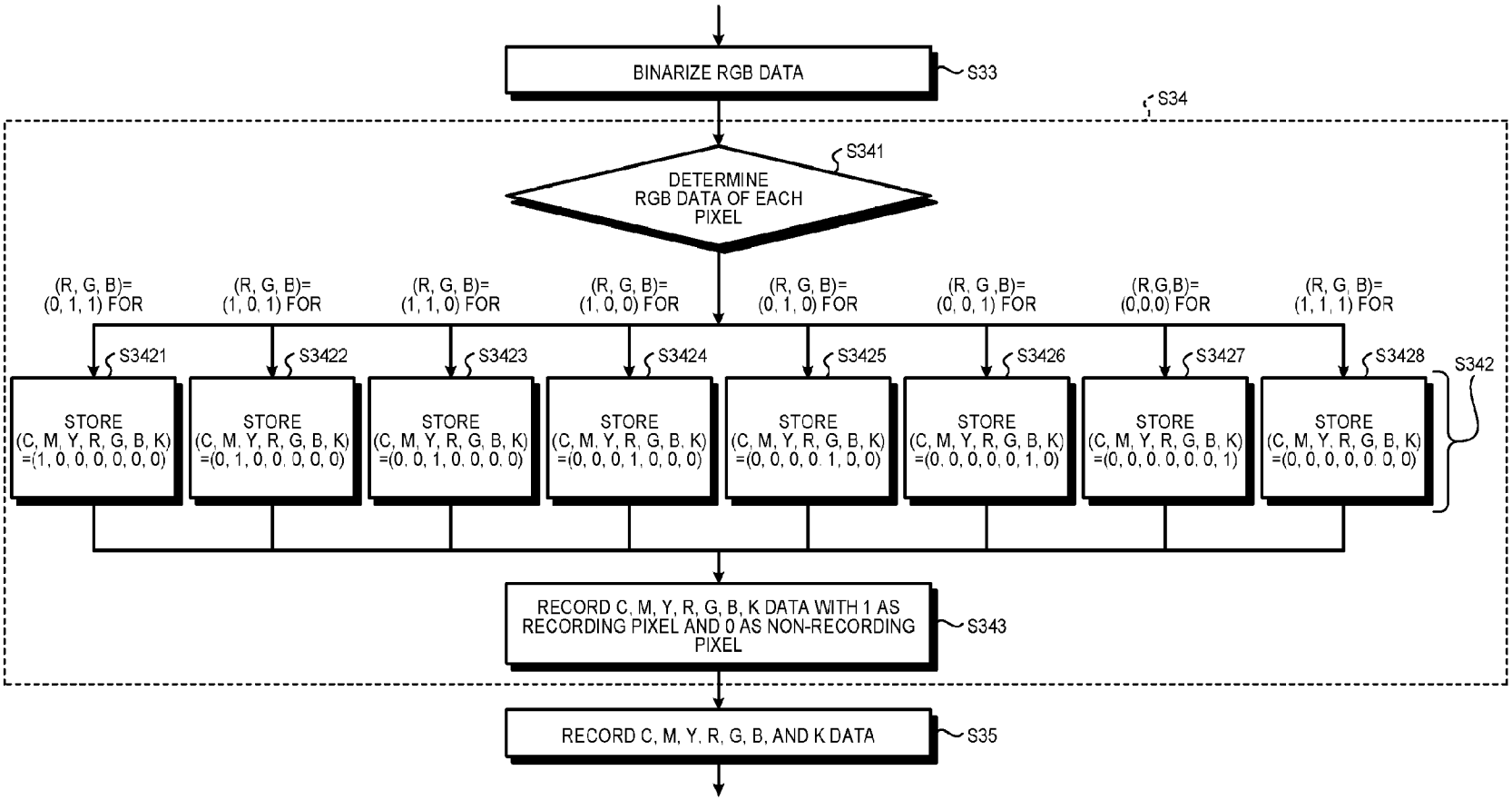
FIG. 32 is a flowchart of a conversion into CMYRGBK data.

FIG. 32 is a flowchart of the conversion into CMYRGBK data.

In the processing at S34, first, the controller 104 determines (a combination of binarized data of) RGB data of each pixel (S341).

Subsequently, the controller 104 performs the conversion into CMYRGBK data as recording data based on the combination of the binarized data of the RGB data (S342).

Specifically, if the combination of the binarized data of the RGB data is (0, 1, 1), in other words, (R, G, B)=(0, 1, 1), the controller 104 sets CMYRGBK data as described below (S3421).

(R, G, B)=(0, 1, 1)->(C, M, Y, R, G, B, K)=(1, 0, 0, 0, 0, 0, 0)

Similarly, if the combination of the binarized data of the RGB data is (1, 0, 1), in other words, (R, G, B)=(1, 0, 1), the controller 104 sets CMYRGBK data as described below (S3422).

(R, G, B)=(1, 0, 1)->(C, M, Y, R, G, B, K)=(0, 1, 0, 0, 0, 0, 0)

If the combination of the binarized data of the RGB data is (1, 1, 0), in other words, (R, G, B)=(1, 1, 0), the controller 104 sets CMYRGBK data as described below (S3423).

(R, G, B)=(1, 1, 0)->(C, M, Y, R, G, B, K)=(0, 0, 1, 0, 0, 0, 0)

If the combination of the binarized data of the RGB data is (1, 1, 0), in other words, (R, G, B)=(1, 0, 0), the controller 104 sets CMYRGBK data as described below (S3424).

(R, G, B)=(1, 0, 0)->(C, M, Y, R, G, B, K)=(0, 0, 0, 1, 0, 0, 0)

If the combination of the binarized data of the RGB data is (0, 1, 0), in other words, (R, G, B)=(0, 1, 0), the controller 104 sets CMYRGBK data as described below (S3425).

(R, G, B)=(0, 1, 0)->(C, M, Y, R, G, B, K)=(0, 0, 0, 0, 1, 0, 0)

If the combination of the binarized data of the RGB data is (0, 0, 1), in other words, (R, G, B)=(0, 0, 1), the controller 104 sets CMYRGBK data as described below (S3426).

(R, G, B)=(0, 0, 1)->(C, M, Y, R, G, B, K)=(0, 0, 0, 0, 0, 1, 0)

If the combination of the binarized data of the RGB data is (0, 0, 0), in other words, (R, G, B)=(0, 0, 0), the controller 104 sets CMYRGBK data as described below (S3427).

(R, G, B)=(0, 0, 0)->(C, M, Y, R, G, B, K)=(0, 0, 0, 0, 0, 0, 1)

If the combination of the binarized data of the RGB data is (1, 1, 0), in other words, (R, G, B)=(1, 1, 1), the controller 104 sets CMYRGBK data as described below (S3428).

(R, G, B)=(1, 1, 1)->(C, M, Y, R, G, B, K)=(0, 0, 0, 0, 0, 0, 0)

This (R, G, B)=(1, 1, 1) represents white, and thus no recording (printing) is needed.

Then, the controller 104 records CMYRGBK data with "1" in CMYRGBK data as a recording (printing) pixel and "0" in CMYRGBK data as a non-recording (non-printing) pixel (S343).

The recording as described above enables full-color recording in colors including green (G) in a short time as compared to recording in single colors.

7.1 First Mode of Sixth Embodiment

Figure 33:
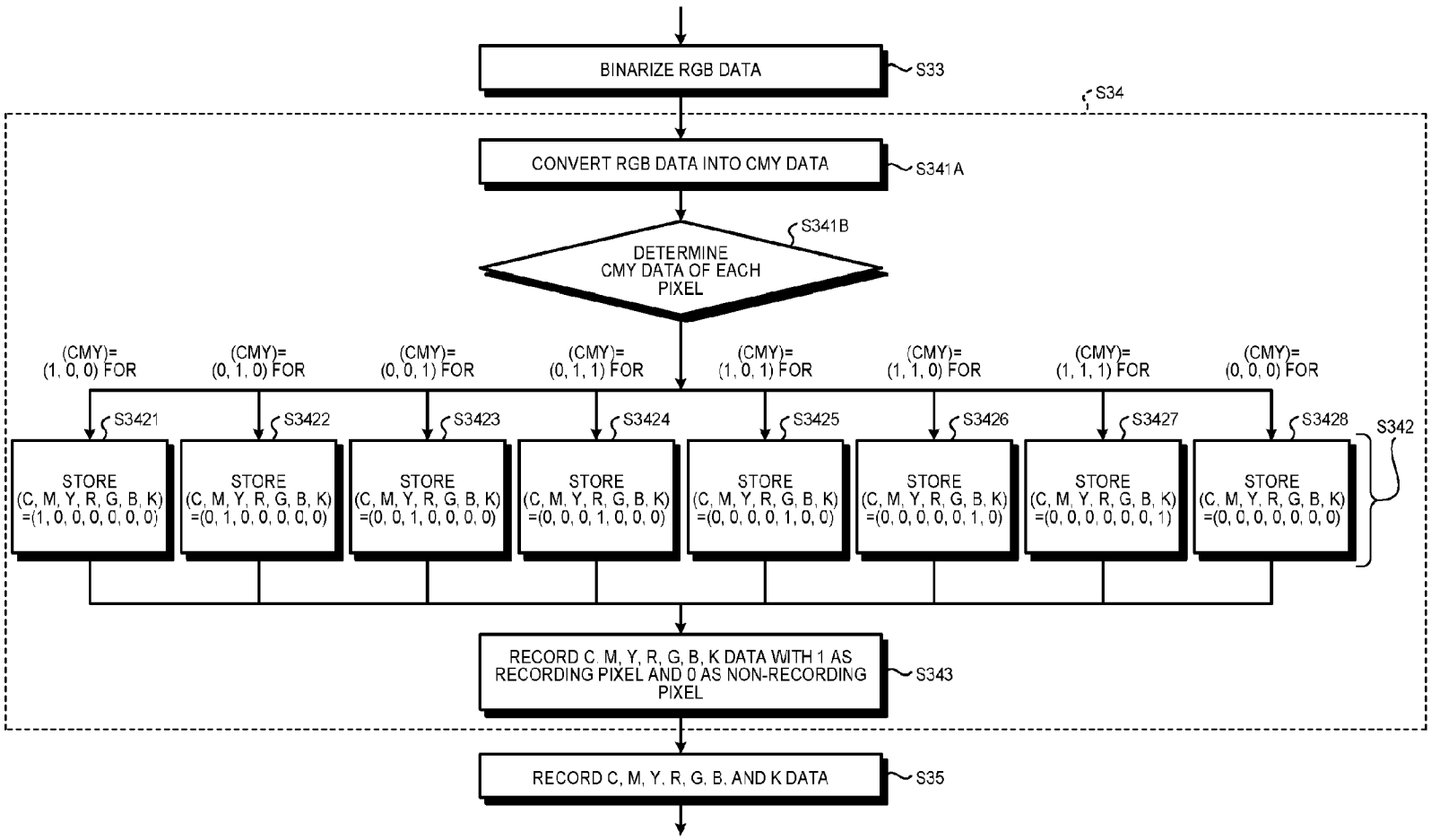
FIG. 33 is a flowchart of an operation in the first mode of a sixth embodiment.

FIG. 33 is a flowchart of an operation according to the first mode of the sixth embodiment.

In FIG. 33, the same parts as those in FIG. 32 are denoted with the same reference symbols. The operation in FIG. 33 differs from that of the first mode in FIG. 32 in that binarized RGB data is converted into CMY data.

According to a modification of the first mode of the sixth embodiment, when the record image data is input (S31), the controller 104 divides (converts) the record image data into RGB data (S32).

Next, the controller 104 binarizes red (R) data, green (G) data, and blue (B) data after the conversion (S33).

Then, the controller 104 converts the binarized RGB data of each pixel into CMYRGBK data (S34).

Subsequently, the controller 104 records an image by controlling the laser head unit 102 and the driver 103 to perform color development in cyan (C), magenta (M), yellow (Y), red (R), green (G), blue (B), and black (K).

The following provides a detailed description of the conversion of the binarized RGB data of each pixel into CMYRGBK data (S34).

In the processing at S34, first, the controller 104 converts the RGB data into CMY data (S341A).

Subsequently, the controller 104 determines (a combination of binarized data of) the CMY data of each pixel (S341B).

Subsequently, the controller 104 performs the conversion into CMYRGBK data as recording data based on the combination of the binarized data of the CMY data (S342).

Then, similarly to the sixth embodiment, the controller 104 performs the processing at S3421 to S3425 and S343.

The recording as described above in the first mode of the sixth embodiment enables full-color recording in a short time as compared to recording in single colors in the modification of the first mode of the sixth embodiment.

7.2 Second Mode of Sixth Embodiment

The following describes an operation according to the second mode of the sixth embodiment.

Figure 34:
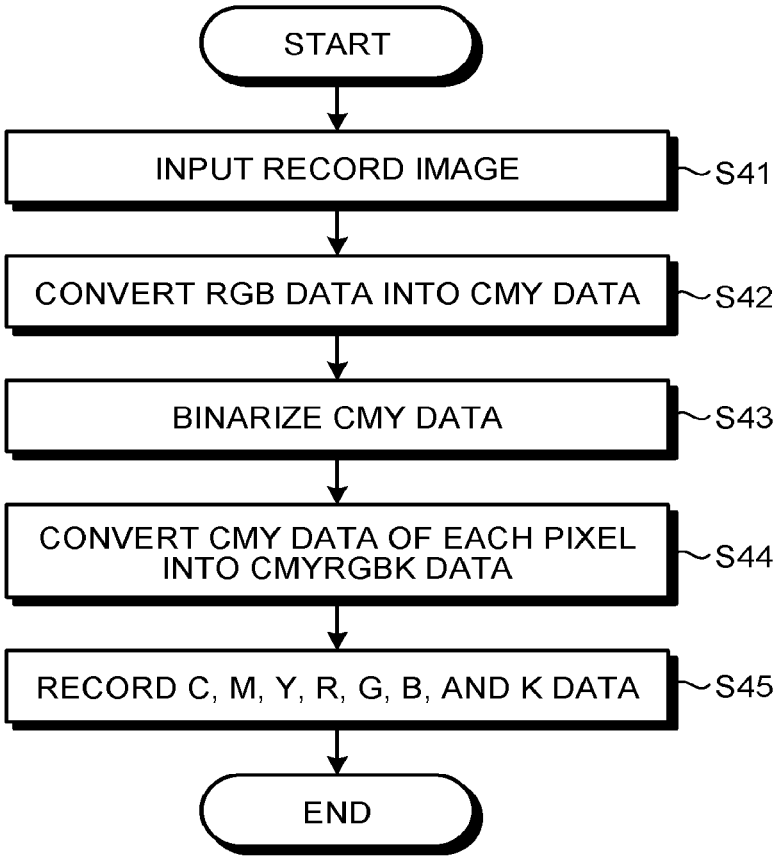
FIG. 34 is a flowchart of an operation according to a second mode of the sixth embodiment.

FIG. 34 is a flowchart of the operation according to the second mode of the sixth embodiment.

First, when the record image data in the RGB data format is input (S41), the controller 104 converts the RGB data into CMY data (S42).

Next, the controller 104 binarizes C (cyan) data, M (magenta) data, and Y (yellow) data after the conversion (S43).

Then, the controller 104 converts the binarized CMY data of each pixel into CMYRGBK data (S44). Specifically, the CMY data is converted into data in cyan (C), magenta (M), yellow (Y), red (R), green (G), blue (B), black (K).

Subsequently, the controller 104 records an image by controlling the laser head unit 102 and the driver 103 to perform color development in cyan (C), magenta (M), yellow (Y), red (R), green (G), blue (B), and black (K) (S45).

The following provides a detailed description of the conversion of the binarized CMY data of each pixel into CMYRGBK data (S44).

Figure 35:
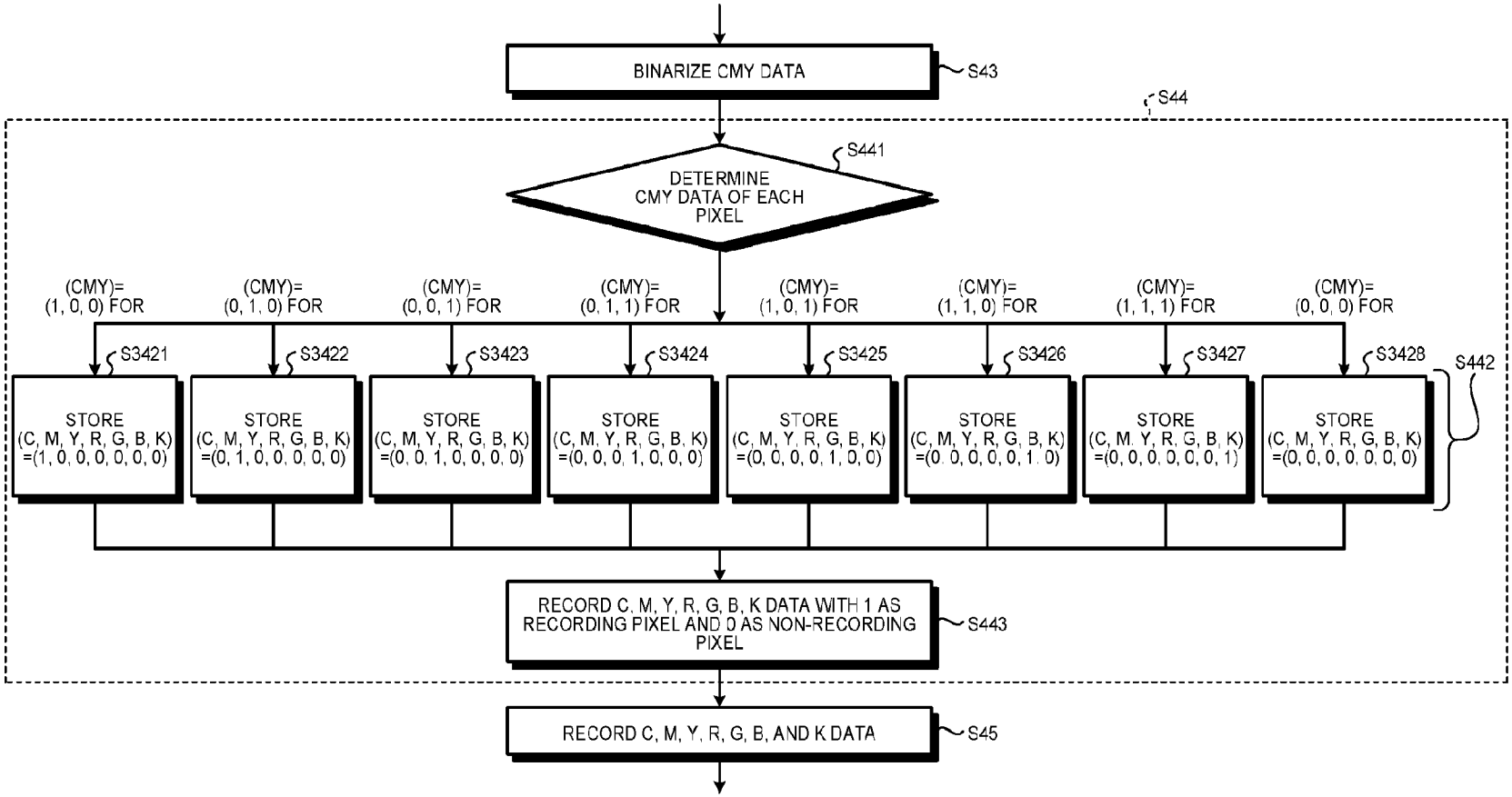
FIG. 35 is a flowchart of a conversion into CMYRGBK data.

FIG. 35 is a flowchart of the conversion into CMYRGBK data.

In FIG. 35, the same parts as those in FIG. 33 are denoted by the same reference symbols, and the detailed description thereof is referred to as needed.

In the processing at S44, first, the controller 104 determines (a combination of binarized data of) the CMY data of each pixel (S441).

Subsequently, the controller 104 performs the conversion into CMYRBK data as recording data based on the combination of the binarized data of the CMY data (S442).

Then, similarly to the first mode of the sixth embodiment, the controller 104 performs the processing at S3421 to S3425 and S343.

The recording as described above in the second mode of the sixth embodiment enables full-color recording in a short time as compared to recording in single colors in the second mode of the sixth embodiment.

As described above, the fourth to the sixth embodiments allow for simultaneous color development in a plurality of colors in parallel, thereby achieving a simplified device configuration while maintaining and improving the quality of a record image, and achieving full-color recording in a shorter time.

The above description is made on the case with three kinds of color developing layers of the low-temperature color developing layer 13, the medium-temperature color developing layer 15, and the high-temperature color developing layer 17. However, four kinds or more of color developing layers may be provided to achieve simultaneous color development of a plurality of color developing layers in parallel in a similar manner.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A laser recording device that performs recording by irradiating a recording medium with laser light, the recording medium including: a plurality of thermal recording layers including thermal materials with different color development threshold temperatures, stacked in an ascending order of the threshold temperatures of the thermal materials from a surface, and irradiated with the laser light; and an intermediate layer provided between the thermal recording layers for thermal insulation and thermal conduction, the laser recording device comprising:

a controller that irradiates the thermal recording layers with the laser light for recording such that the higher the threshold temperature of the thermal recording layers, the relatively higher a power density of the laser light irradiating the thermal recording layers, and that the lower the threshold temperature of the thermal recording layers, the effectively longer a length of irradiation time for the thermal recording layers, wherein the controller repeatedly scans the thermal recording layers with the laser light a plurality of times for recording on each recording position, and sets a waiting time to a length of time from a previous scanning to a current scanning with the laser light at a same recording position such that the lower the threshold temperature of the thermal recording layers, the longer the waiting time is set.

2. The laser recording device according to claim 1, wherein the controller sets the number of irradiations with the laser light, the number of irradiations being larger at an identical recording position for any of the thermal recording layers with a lower threshold temperature.

3. The laser recording device according to claim 1, wherein the controller performs the recording on the thermal recording layers individually.

4. A recording method by a laser recording device that performs recording by irradiating a recording medium with laser light, the recording medium including: a plurality of thermal recording layers including thermal materials with different color development threshold temperatures, stacked in an ascending order of the threshold temperatures of the thermal materials from a surface, and irradiated with the laser light; and an intermediate layer provided between the thermal recording layers for thermal insulation and thermal conduction, the method comprising:

irradiating the thermal recording layers with the laser light for recording such that the higher the threshold temperature of the thermal recording layers, the relatively higher a power density of the laser light irradiating the thermal recording layers, and that the lower the threshold temperature of the thermal recording layers, the effectively longer a length of irradiation time for the thermal recording layers; and repeatedly scanning the thermal recording layers with the laser light a plurality of times for recording on each recording position, and setting a waiting time to a length of time from a previous scanning to a current scanning with the laser light at a same recording position such that the lower the threshold temperature of the thermal recording layers, the longer the waiting time is set.

* * * * *